US006380869B1

(12) United States Patent
Simon et al.

(10) Patent No.: US 6,380,869 B1
(45) Date of Patent: Apr. 30, 2002

(54) AUTOMATED AIR-TRAFFIC ADVISORY SYSTEM AND METHOD

(75) Inventors: Gary B. Simon, Winchester, MA (US); David Wartofsky, Fort Washington, MD (US)

(73) Assignee: Potomac Aviation Technology Corporation, Boston, MA (US)

( * ) Notice: Subject to any disclaimer, the term of this patent is extended or adjusted under 35 U.S.C. 154(b) by 0 days.

(21) Appl. No.: 09/314,363

(22) Filed: May 19, 1999

(51) Int. Cl.[7] ..... G08B 21/00

(52) U.S. Cl. ..... 340/945; 340/961; 340/970; 701/14; 701/3; 701/301; 342/29

(58) Field of Search ..... 340/945, 961, 340/970; 701/14, 301, 3; 342/29

(56) References Cited

U.S. PATENT DOCUMENTS

| | | | | |
|---|---|---|---|---|
| 3,235,838 | A | 2/1966 | Hilt | 340/26 |
| 3,281,789 | A | 10/1966 | Willcox et al. | 340/152 |
| 3,373,405 | A | 3/1968 | Gadbois | 340/147 |
| 3,598,910 | A | 8/1971 | Johnston et al. | 178/6.6 R |
| 3,668,403 | A | 6/1972 | Meilander | 235/150.23 |
| 3,699,443 | A | 10/1972 | Weger | 325/4 |
| 3,737,782 | A | 6/1973 | Pierce | 325/363 |
| 3,907,223 | A | 9/1975 | Crane | 244/77 A |
| 3,914,692 | A | 10/1975 | Seaborn, Jr. | 325/53 |
| 3,949,399 | A | 4/1976 | Huber et al. | 343/100 |
| 4,043,194 | A | 8/1977 | Tanner | 73/178 |
| 4,048,564 | A | 9/1977 | Gleeson, Jr. | 325/67 |
| 4,079,905 | A | 3/1978 | Greene | 244/191 |
| 4,093,937 | A | 6/1978 | Habinger | 340/26 |
| 4,103,300 | A | 7/1978 | Gendreu et al. | 343/6 R |
| 4,162,449 | A | 7/1979 | Bouyssounouse et al. | 325/55 |
| 4,163,216 | A | 7/1979 | Arpino | 340/152 |
| 4,234,952 | A | 11/1980 | Gable et al. | 370/94 |
| 4,295,139 | A | 10/1981 | Arpino | 340/152 |
| 4,318,076 | A | 3/1982 | Whitfield | 340/27 NA |
| 4,354,275 | A | 10/1982 | Bouyssounouse et al. | 455/54 |
| 4,519,069 | A | 5/1985 | Pudsey | 370/85 |
| 4,521,857 | A | 6/1985 | Reynolds, III | 364/439 |
| 4,635,285 | A | 1/1987 | Coombes | 379/63 |
| 4,706,198 | A | 11/1987 | Thurman | 364/439 |
| 4,744,083 | A | 5/1988 | O'Neill et al. | 371/22 |

(List continued on next page.)

FOREIGN PATENT DOCUMENTS

| | | | |
|---|---|---|---|
| EP | A 0 319 491 | 6/1989 | G01W/1/00 |
| FR | A 2 654 536 | 5/1991 | G08B/5/00 |
| JP | 2134929 A | 5/1990 | 455/67.4 |
| WO | WO 96/02905 | 1/1996 | |

OTHER PUBLICATIONS

F.A.A. Advisory Circular, "Automated Weather Observing Systems (AWOS) for Non–Federal Applications", AC No. 150/5220–16A, Jun. 12, 1990, pp. 1–51.

"The Automatic Terminal Advisory System" Marketing material and system specifications. Some dates given, no dates confirmed.

*Primary Examiner*—Daryl Pope
(74) *Attorney, Agent, or Firm*—Hamilton, Brook, Smith & Reynolds, P.C.

(57) ABSTRACT

A method and apparatus for automatically providing advisories to pilots in a monitored airspace comprises monitoring weather conditions and air traffic in an airspace and then generating and broadcasting advisories over a radio channel in response to relevant air traffic conditions. Advisory lengths are sized based on the volume of communications on the common traffic advisory frequency. An airspace model, made up of a multitude of constantly updated records, is used to keep track of important flight information and weather conditions. A monitoring CPU, accessing the airspace model, creates the advisory messages based upon hazard criteria, guidelines, airport procedures and other relevant air traffic data.

67 Claims, 15 Drawing Sheets

U.S. PATENT DOCUMENTS

| | | | | | |
|---|---|---|---|---|---|
| 4,777,656 | A | | 10/1988 | Wade | 455/98 |
| 4,780,715 | A | | 10/1988 | Kasugai | 340/825.08 |
| 4,788,543 | A | | 11/1988 | Rubin | 340/825.44 |
| 4,792,803 | A | | 12/1988 | Madnick et al. | 340/905 |
| 4,839,645 | A | | 6/1989 | Lill | 340/870.17 |
| 4,857,030 | A | | 8/1989 | Rose | 446/303 |
| 4,914,733 | A | | 4/1990 | Gralnick | 340/961 |
| 4,970,510 | A | | 11/1990 | Stelling | 340/945 |
| 5,025,382 | A | | 6/1991 | Artz | 364/439 |
| 5,027,427 | A | | 6/1991 | Shimizu | 455/67 |
| 5,105,191 | A | | 4/1992 | Keedy | 340/968 |
| 5,153,836 | A | | 10/1992 | Fraughton et al. | 364/461 |
| 5,210,611 | A | | 5/1993 | Yee et al. | 358/191.1 |
| 5,223,847 | A | | 6/1993 | Minter | 342/417 |
| 5,265,024 | A | | 11/1993 | Crabill et al. | 364/443 |
| 5,282,204 | A | | 1/1994 | Shpancer et al. | 370/94.2 |
| 5,305,374 | A | | 4/1994 | Snyder | 379/67 |
| 5,353,326 | A | | 10/1994 | Jung | 379/6 |
| 5,361,402 | A | | 11/1994 | Grube et al. | 455/67.1 |
| 5,396,651 | A | | 3/1995 | Nitardy | 455/54.2 |
| 5,434,565 | A | | 7/1995 | Simon et al. | 340/949 |
| 5,463,382 | A | | 10/1995 | Nikas et al. | 340/825.44 |
| 5,486,829 | A | | 1/1996 | Potier et al. | 342/40 |
| 5,530,440 | A | | 6/1996 | Danzer et al. | 340/933 |
| 5,565,863 | A | * | 10/1996 | Simon et al. | 340/947 |
| 5,570,095 | A | | 10/1996 | Drouilhet, Jr. et al. | 342/357 |
| 5,574,648 | A | | 11/1996 | Pilley | 364/439 |
| 5,604,504 | A | | 2/1997 | Nail | 342/417 |
| 5,717,406 | A | | 2/1998 | Sanderford et al. | 342/457 |
| 5,757,322 | A | | 5/1998 | Ray et al. | 342/460 |
| 5,798,726 | A | | 8/1998 | Schuchman et al. | 342/37 |
| 6,127,944 | A | * | 10/2000 | Daly et al. | 340/963 |

* cited by examiner

APPROACH SERVICES SUBROUTINE

AUTOMATED AIR-TRAFFIC ADVISORY SYSTEM AND METHOD

BACKGROUND OF THE INVENTION

Air traffic at large airports is generally managed and pilots are apprised of danger by an air traffic controller during operating hours of the control tower. Smaller airports, however, rarely have the traffic to justify the expenses associated with the equipment and salaries of the tower crew. As a result, pilots of smaller aircraft generally must monitor air traffic and weather conditions themselves, compounding their full-time task of navigating and piloting the airplane.

Without the guiding voice of an air traffic controller, pilots in the vicinity of airports not having a control tower manage themselves by relaying messages to each other over a shared communication radio frequency known as a Common Traffic Advisory Frequency (CTAF). Basically, the CTAF serves as a bulletin board where pilots broadcast general declarations to alert each other of their planned course of action. Consequently, each airport has its own CTAF channel, which is assigned and published by the FCC and which pilots find through various airport information sources.

There are drawbacks associated with pilots at non-towered airports coordinating their own traffic flow using the CTAF channel. Broadcasts are rarely to a particular party and important messages can be confusing due to the fact that a pilot must rely on the ability of a transmitting party to communicate an intelligible and accurate message. Moreover, an inattentive pilot may not even broadcast a message concerning his intentions at all, leaving pilots unaware of potentially dangerous circumstances. As a result, there is a constant desire among pilots to develop tools to increase awareness and, hence, air traffic safety.

A number of other systems have been proposed to enhance air traffic safety. These systems include electronic surveillance devices, the primary purpose of which is to alert pilots about the presence, and sometimes location, of aircraft and inclement weather conditions that pose an immediate threat to the pilot and passengers on board.

Systems have also been proposed in which a visual display is used to alert pilots when another aircraft is close in proximity. For example, one pilot advisory system tracks the location and associated trajectories of aircraft in the vicinity of a protected aircraft. When the monitored air traffic data indicates that two aircraft are getting too close to each other, the computer generates a climb or descend recommendation and displays the information on a screen for the pilot. Contrasting colors and descriptive symbols on the display aid in conveying the appropriate message to the pilot.

Other weather advisory systems monitor and compile storm location data. At the request of a subscriber-pilot, a microprocessor processes weather data to correct for an aircraft's position and heading in order to display, on a screen, storm locations relative to the aircraft. In this way, pilots are alerted to the location and presence of dangerous weather conditions, i.e. lightning storms, so that danger may be avoided.

Unfortunately, like other high cost electronics, few owners of smaller aircraft can afford these more elaborate electronic surveillance systems found in larger commercial aircraft. As a result, smaller aircraft are often at a higher risk.

Certain weather advisory systems, however, have been deployed at non-towered airports to assist pilots. Automatic Weather Observation Systems (AWOS) automatically provide weather information to pilots over a dedicated communication frequency. This frequency, like the CTAF channel, is also assigned and published by the FCC. Typically, the AWOS unit will monitor wind speed, direction and other important meteorological characteristics of the airport. After the weather information is compiled and processed by a computer, it is transmitted to pilots over the AWOS channel in the form of a synthesized audio message. After hearing this message on the dedicated channel, an approaching pilot, for example, may select an appropriate landing runway based upon present weather conditions at the airport.

A major drawback of the AWOS, is the fact that it requires a dedicated channel different than the Common Traffic Advisory Frequency (CTAF) channel. To simultaneously monitor both the AWOS and CTAF channels, a pilot must have two radios. And even if two radios are available, it is impractical to listen to two radios at the same time. If a cockpit is equipped with only one radio, the pilot must manually change the channel depending on which information, AWOS or CTAF, is desired at the time. Furthermore, whether or not a given aircraft has two radios, the pilot must still draw their attention away from the CTAF channel to listen to the weather only broadcast from an AWOS. A pilot, as a result, may miss critical flight information while listening to one channel in lieu of the other. Moreover, the act of changing the radio channel takes a pilot's attention away from the important task of flying the airplane.

Another, deployed weather advisory system involves broadcasting weather information over the CTAF channel in response to pilot requests. One method of making such a pilot information request is by rapidly clicking a pilot's radio microphone a predetermined number of times. For example, three quick successions of pressing and releasing the transmit button on the cockpit radio indicates a request for an update of the weather in the immediate area. In response to the microphone clicking, the advisory system monitoring the CTAF channel then broadcasts a message based upon present weather conditions, where the length and content of the message depends on the volume of traffic on the CTAF channel. When the volume of traffic on the CTAF channel is heavy, messages are shortened so as not to interfere with pilot transmissions.

SUMMARY OF THE INVENTION

Without the guiding voice of an air traffic controller, pilots in the vicinity of small airports must monitor air traffic and weather conditions themselves compounding the full-time task of navigating and piloting the airplane.

It would be an advancement in the art to provide a low cost advisory system that monitors weather and aircraft location information from a centralized base station which automatically broadcasts relevant advisory messages over a shared communication channel to alert pilots of relevant air traffic information.

According to one aspect, the present invention concerns an apparatus for broadcasting pilot advisories at airports. The system comprises a CPU linked to an aircraft monitoring subsystem and a transmitter for broadcasting messages to pilots. The aircraft monitoring subsystem generates aircraft location information that is transferred to the monitoring CPU. The CPU, in turn, uses the data to track aircraft in the monitored airspace. Based on the this information, the CPU generates advisory messages that are automatically broadcasted to pilots via the transmitter, providing them with air traffic information.

In specific embodiments, the present invention includes a weather substation linked to the monitoring CPU and a data storage device for recording relevant air traffic information. Based on the monitored weather conditions and air traffic trends, the CPU issues advisories to pilots in the monitored airspace. Weather advisories may depend on the location of the aircraft. For example, an aircraft approaching a runway, presumably attempting to land, would be issued an advisory regarding wind speed and direction. In addition, an advisory message describes procedures with respect to landing an aircraft or other related activities. Advisories are generated using a voice synthesizer so that a pilot, beyond the limitations of visually scanning for traffic, may listen to a radio channel to keep abreast of important air traffic information. In other respects, an operator interface enables airport personnel to program messages related to specific airport incidents, conditions and/or procedures.

Preferably, the pilot advisory system includes aircraft surveillance equipment that monitors the location of aircraft in a given airspace. Examples include mode A, C or S receivers and transponders. The monitoring computer, while tracking the aircraft locations, labels each aircraft with a unique name to facilitate targeting sensible advisories to appropriate parties. Further, the invention includes alternate communication links where messages are transmitted to parties other than pilots. For example, using a telephone link, appropriate authorities are notified if an aircraft comes to an abrupt halt, presumably as a result of a an aircraft accident, while attempting to land or takeoff from a runway.

In other aspects of the embodiments, a device is provided that monitors, for example, a communication channel, and detects pilot advisory requests. In response to a pilot request, a transmitter broadcasts the information over the radio channel. In this way, a pilot, for example, retrieves location information to resolve uncertainty as to bearing or position. The radio channel is also monitored for activity so that the length of an advisory message is optimized, since it is undesirable to interfere with pilot conversations.

According to another aspect, the present invention also concerns a method for broadcasting pilot advisories at airports. The method includes monitoring and tracking aircraft location information in an airspace, generating advisories in response to the aircraft location information and broadcasting the advisories to pilots over a radio channel. In this way, pilots are alerted to air traffic information.

Another aspect of the invention is the ability of the airspace monitoring device to determine aircraft location in three dimensional space. This includes interrogating aircraft with surveillance devices, such as mode A, C or S transponders, and converting the received signals into aircraft location information. The monitoring computer, while tracking the aircraft locations, labels each aircraft with a unique name to facilitate targeting advisories to appropriate parties. And in addition to conveying advisory messages to pilots, the advisory system also conveys messages to parties other than pilots using an alternative communication link such as a telephone line.

In other specific embodiments, the claimed invention includes monitoring a radio channel and detecting pilot advisory requests. A monitoring computer, in response, generates an advisory message that is broadcasted over the radio channel.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
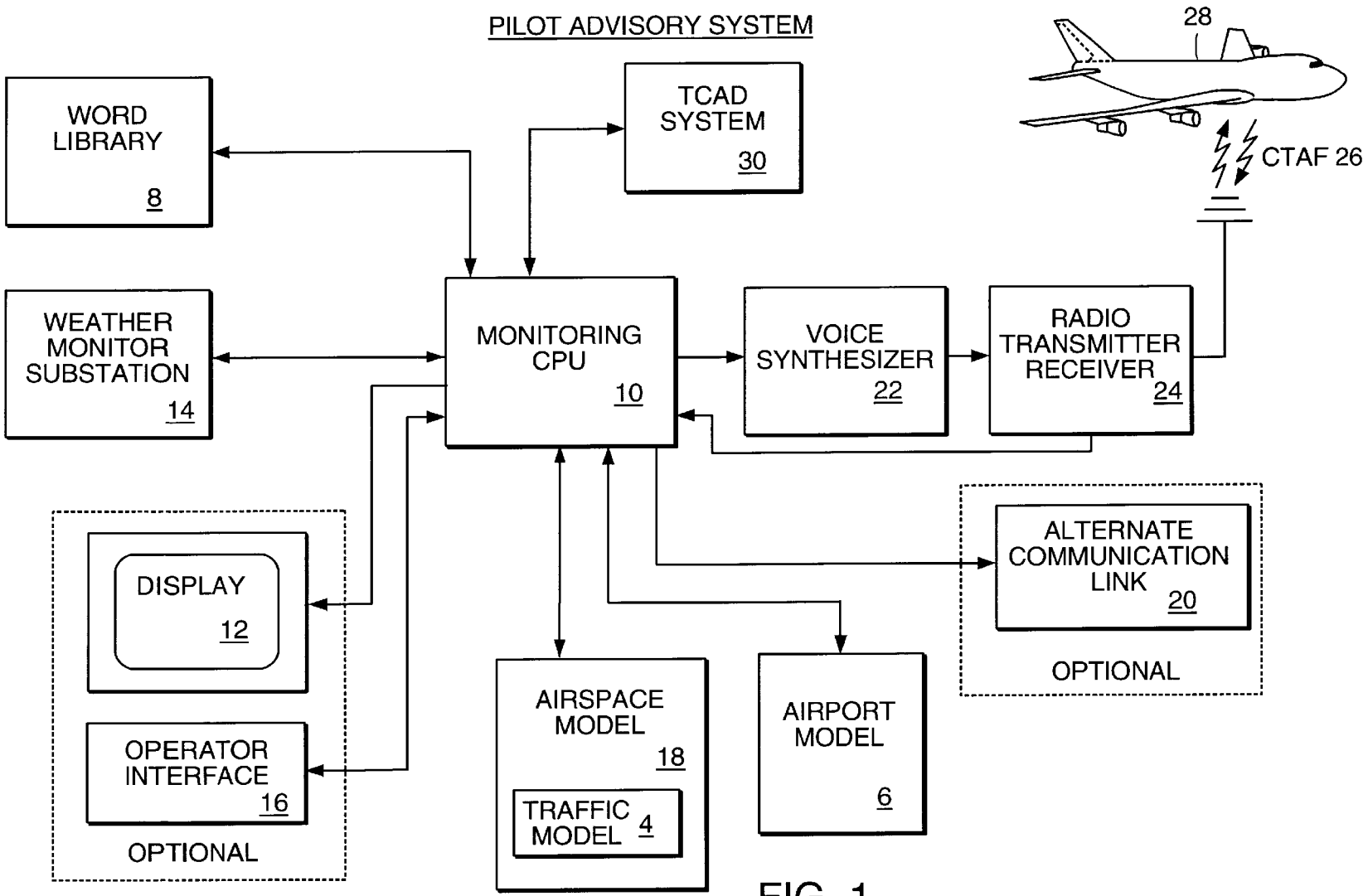
FIG. 1 is a block diagram of the Pilot Advisory System using a TCAD system according to the present invention.

Turning to the figures, FIG. 1 shows an automatic pilot advisory system, which has been constructed according to the principles of the present invention. In the preferred embodiment, a monitoring CPU 10 is interfaced to a Traffic Collision and Detection (TCAD) system 30 and a weather monitor substation 14. The TCAD system 30 provides three dimensional aircraft location while the weather monitor substation, as its name suggests, provides relevant air traffic weather data. This information, once retrieved, is stored in the appropriate mathematical model.

The monitoring CPU 10 reviews and updates information stored in mathematical models to generate accurate and relevant pilot advisories. Two such mathematical models in the pilot advisory system are airport model 6 and airspace model 18, which are comprised of relevant air traffic control information. Within airspace model 18 is a traffic model 4 where records are maintained about aircraft location and associated trajectories (i.e., dynamic aspects of the monitored airspace).

Static aspects of a monitored airspace are recorded in airport model 6. This model is tailored to reflect the physical attributes of a particular airport since every airport has its own unique geographical signature. The geographical features in the airport model 6 are generally static over time and, once programmed, need relatively few updates. Recorded attributes include aspects such as angle of runway, type of runway (i.e., asphalt or dirt), approach/depart procedures, headings and airport procedures.

Figure 12:
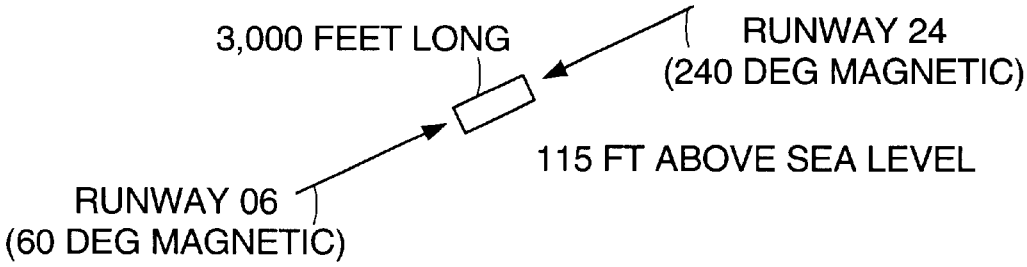
FIG. 12 illustrates some of the physical features in an airport model of the present invention.

FIG. 12 shows an example of a sample runway and some associated attributes, which are stored in airport model 6. Specifically, in this illustrated example, "runway 06" heading at 60° magnetic is 3,000 feet long and 115 feet above sea level. "Runway 24" has a heading of 240° magnetic, and is also 3000 feet long.

Dynamic aspects of the airspace are monitored and recorded in airspace model 18 which is constantly updated with fresh data. Examples of monitored dynamic attributes include aircraft location information, flight patterns, weather conditions, CTAF channel traffic, and other relevant air traffic data and procedures.

Figure 13A:
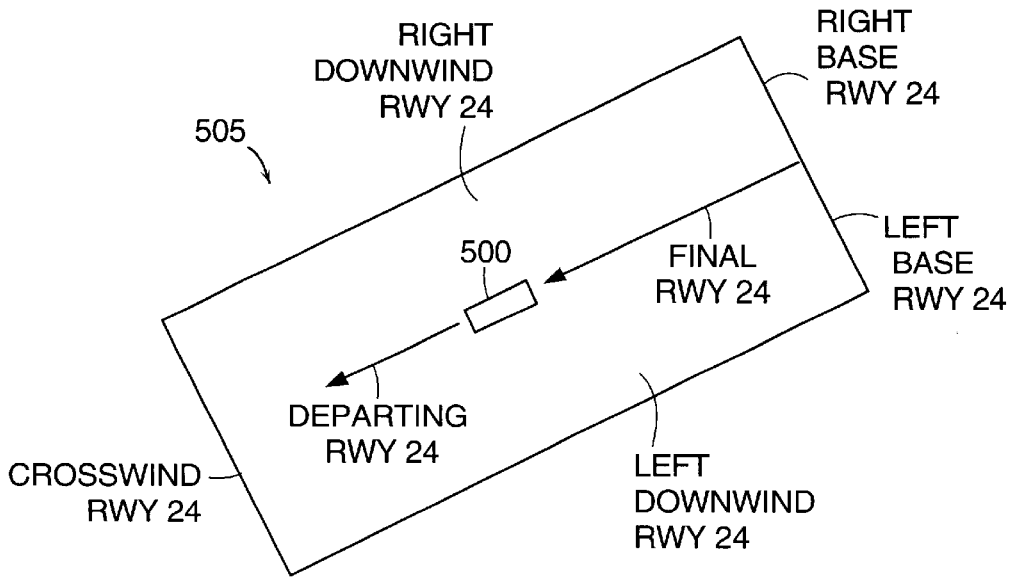
FIG. 13A is an example of an air traffic pattern within an airspace model according to the principles of the present invention.
Figure 13B:
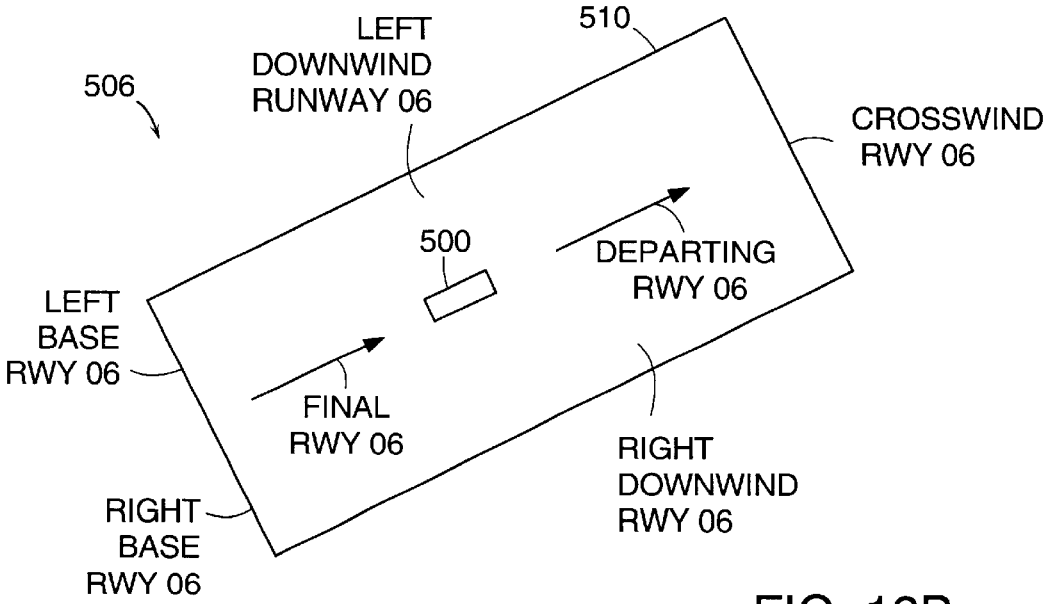
FIG. 13B is an example of another air traffic pattern within an airspace model according to the principles of the present invention.

FIGS. 13A and 13B show examples of two air traffic patterns 505, 506 and associated terminology for each flight leg 510. The traffic patterns 505 and 506 are stored in airspace model 18 and are activated depending on wind direction. Specifically, traffic pattern 505 in FIG. 13A shows "runway 24" 500, left and right base runway 24, crosswind runway 24, along with right and left downwind runway 24. As illustrated in FIG. 13B, similar attributes are stored in the airspace model 18 for "runways 06" 500.

Referring again to FIG. 1, the traffic model 4 within airspace model 18 tracks target aircraft in the monitored airspace.

Figure 14A:
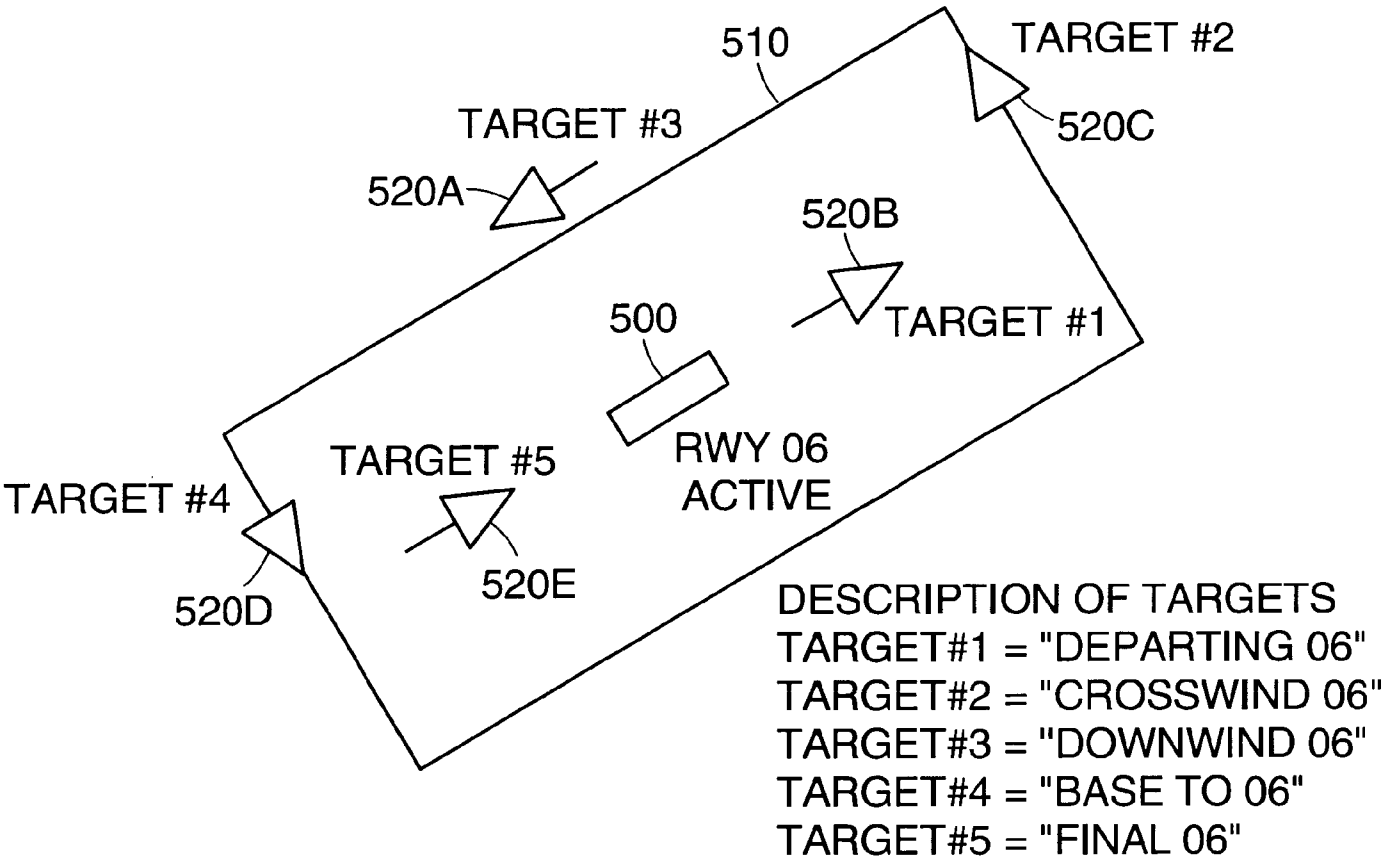
FIG. 14A is an example of tracked targets within an airspace model of the present invention.

FIG. 14A illustrates the terminology used by the system to address tracked aircraft in the monitored air space. Specifically, relative to the active runway "runway zero-six" 500, target #1 520B is addressed as "departing zero-six," target #2 520C flying transversely to runway 500 is addressed as "crosswind zero-six." Target #3 520A is addressed as "downwind zero-six." Target #4 520D is addressed as "base to zero-six." Finally, target #5 520E is addressed as "final zero-six."

Figure 14B:
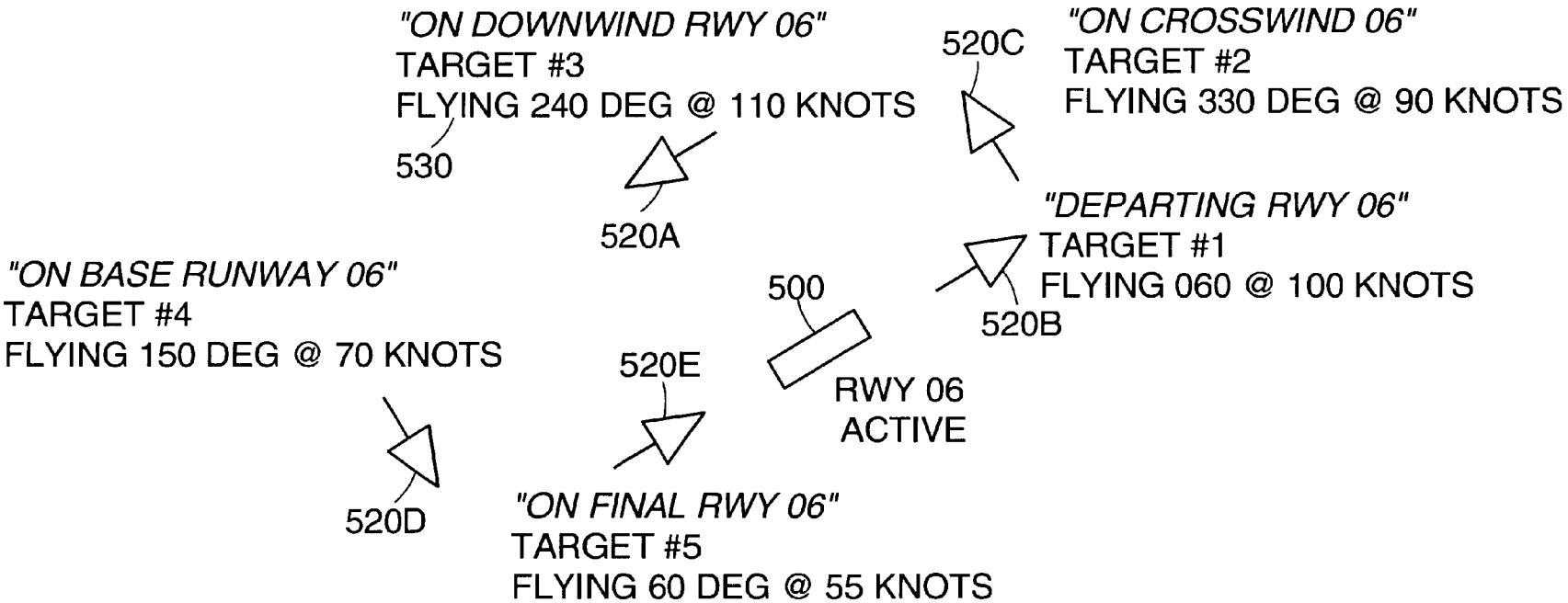
FIG. 14B shows the descriptive terminology associated with tracked targets in an airspace model according to the present invention.

FIG. 14B illustrates information stored for each target in the traffic model 4. Specifically, for each of these targets #1–5, 520A–520E, aircraft heading and speed information is stored in the traffic model 4. For example, target #2 520C is flying at a direction of 330° at 90 knots. In contrast, target #5 520A on final approach to runway 06 500 is flying at 60° at 55 knots.

Programming attributes of each and every airport can be tedious and highly variable for the airport model 6 and airspace model 18. Therefore, in the preferred embodiment the pilot advisory system learns attributes such as air traffic flow based on observing air traffic flow in an airspace. In other words, preferred flight paths are determined and recorded based on statistical data of observed flight patterns. For example, aircraft landing at the airport are observed to determine the commonly used approach paths for landing an aircraft. Therefore, based on the position of an aircraft, the pilot advisory system is capable of guiding any aircraft to land based on the observed landing path even in zero visibility weather. In addition to refining an air traffic pattern in the airspace model 18, the observed flight path of aircraft are used to anticipate traffic flow. For instance, aircraft outside a monitored airport traveling in the direction of a particular runway are anticipated, based on historical data, to land on that runway.

TCAD system 30 is a commercially available device that monitors transponders, usually located on an aircraft 28, that transmit digitally encoded aircraft and vehicle identification information over a radio frequency channel. After retrieved transponder data are compiled and reformatted by the TCAD system 30, they are transferred to the monitoring CPU 10 which uses the data to update the airspace model 18 records.

An aircraft transponder generally includes both an RF receiver and transmitter specially tuned to an assigned frequency channel. The receiver monitors the airwaves for interrogation signals transmitted by surveillance devices in the surrounding area. Interrogation signals are the means by which a surveillance device requests responses from local transponders. When an interrogation signal is detected, the transponder in turn generates and transmits digitally encoded aircraft data over the appropriate radio frequency.

The surveillance device issuing the interrogation signal, thereafter, "listens" to responding transponders and retrieves the digitally encoded aircraft information. Once retrieved and decoded, the data are transferred to the monitoring CPU 10, which stores the information in the airspace model 18 and, in particular, the traffic model 4. Since transponders have a limited range, only devices within range will respond to any given interrogation signal.

There are two types of aircraft transponder tracking systems: active and passive. Active systems are capable of generating interrogation signals that elicit the response of other nearby transponders. Depending on the type, a transponder responds to an interrogation signal with a different, but predetermined, level of digitally encoded information. For instance, some transponders respond only with aircraft identification information while other, more elaborate transponders respond with more detailed information including aircraft location. TCAS systems, in general, are active devices capable of broadcasting interrogation signals and retrieving transponder response data.

Passive aircraft transponder tracking systems, on the other hand, are not capable of generating their own interrogation signal to elicit the response of nearby transponders. Rather, passive systems rely on the interrogation signals generated by other nearby active systems. In essence, passive systems eavesdrop on the appropriate frequency to collect transponder response information about local aircraft.

TCAD systems fall into this class of passive devices. Incidentally, transponder responses, sometimes referred to as "squawks", are elicited by a number of devices including the interrogation signals of other transponder tracking systems, as mentioned, or ground-based radar systems. There are a number of commercially available transponders including mode A, mode C and mode S types.

In one embodiment, the TCAD system 30 as shown in FIG. 1 does not issue interrogation signals operating as a passive device. It does, however, monitor the transponder "squawks" or responses resulting from interrogation signals issued by nearby devices. Essentially, the TCAD system 30 merely listens to the activity of transponders within its range. It then collects aircraft location information and formats the data for the monitoring CPU 10. In one embodiment, a Ryan 9900B TCAD system is used. However, any commercially available TCAD system is a viable substitute for the Ryan 9900B.

The location of the TCAD system 30 is preferably near the monitored airport, but the whole or part of the pilot advisory system may be located almost anywhere. In one embodiment, the system and its components are physically located in the vicinity of an airport. However, a substantial part of the device may be incorporated in a ground based mobile unit, an airborne device or even a satellite system.

Additionally, it should be noted that although the pilot advisory system is located at an airport in the preferred embodiment, such a system is also designed to monitor airspace between airports. In other words, the system is also designed to monitor "en route" air traffic between airports. The principles of the invention apply to either setting.

After the encoded RF data is collected and processed by the TCAD system 30, the aircraft information is relayed to the monitoring CPU 10 which then updates the records in the airspace model 18 and, in particular, the traffic model 4.

Figure 2:
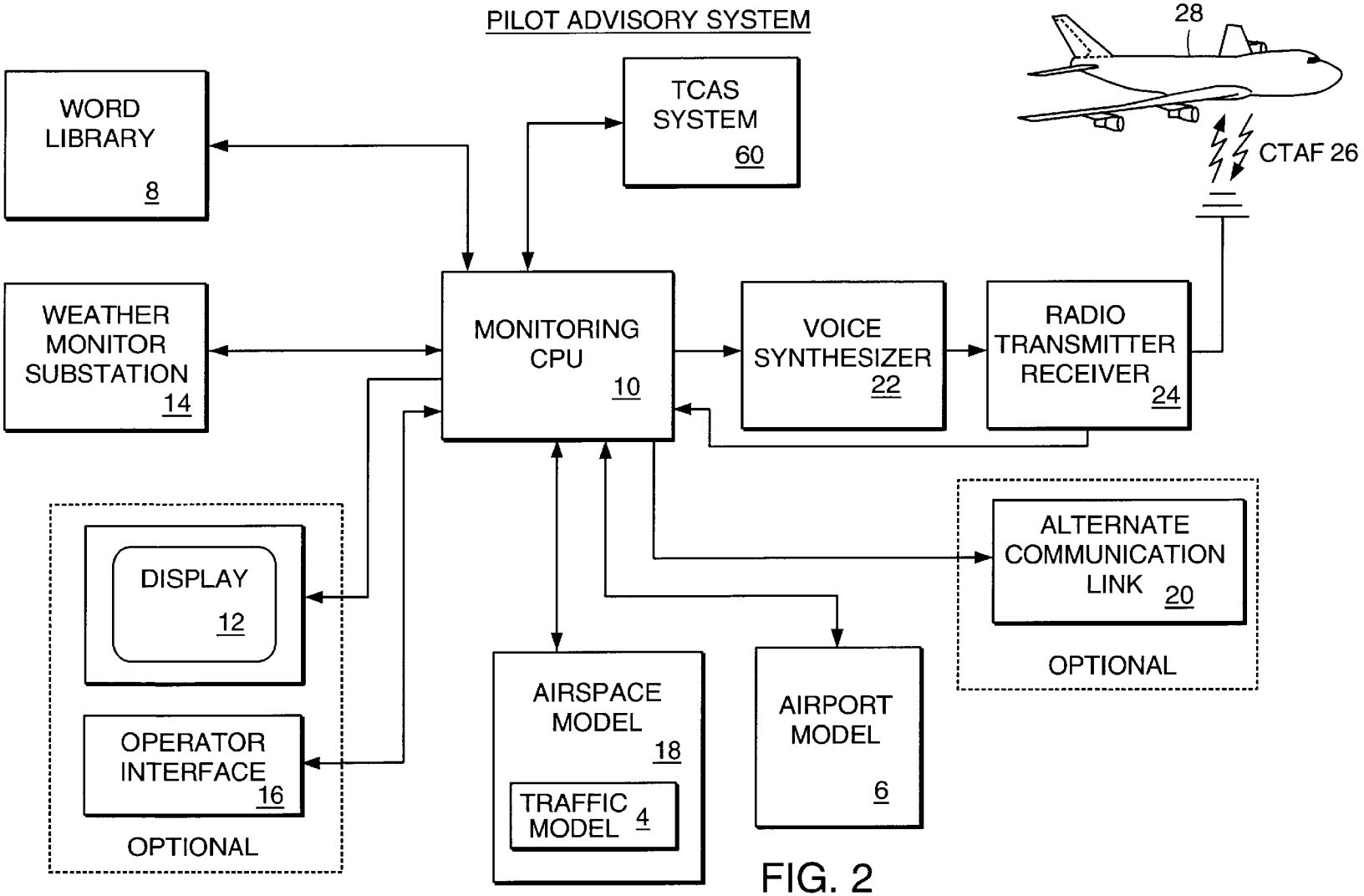
FIG. 2 is a block diagram of the Pilot Advisory System using a TCAS system according to the present invention.

In another embodiment of the present invention, a TCAS system 60, rather than a TCAD system, is used to monitor local aircraft as shown in FIG. 2. The TCAS system 60, otherwise known as a Traffic Collision and Avoidance System, interfaces to the monitoring CPU 40 and generally performs the same duties as the aforementioned TCAD system 30 in FIG. 1. Similar to TCAD systems, transponder response information is monitored by the TCAS system. However, unlike TCAD systems, the TCAS system issues interrogation signals eliciting transponder responses.

One example of a commercially available TCAS system 60 used in the pilot advisory system is a "Skywatch" system manufactured by the BF Goodrich Corporation. However, any commercially available TCAS system is a viable substitute.

According to the principles of the present invention, other aircraft surveillance systems may be used to generate aircraft location information. For example, ground-based radar systems that rely on the primary reflections of their own directional RF emissions are another means of determining the location of aircraft within a given airspace. Also, Global Position System (GPS) devices and systems enable one to track the location of an aircraft. Regardless of the apparatus, one aspect of the invention includes a means of retrieving accurate aircraft location information.

Referring again to FIG. 1, the monitoring CPU 10 is also linked to a weather monitor substation 14 that provides local weather information. The weather monitor substation 14 monitors critical flight parameters such as wind speed, wind direction, temperature, and barometric pressure using appropriate sensing instruments. This information, digitally encoded, is provided to the monitoring CPU 10 which updates the airspace model 18 accordingly. Thereafter, the monitoring CPU 10 generates advisories based on the present weather conditions and positions of other relevant aircraft. According to the principles of the present invention, important weather information may be obtained from other sources capable of compiling weather data or sensing weather parameters.

It is understood that both microprocessor and microcontroller systems include supporting I/O and interface devices. These supporting features enable the CPU to perform its basic duties, which to a large extent is retrieving and storing data from other electronic modules in the pilot advisory system. For example, the microprocessor system is interfaced to a display 12 and an operator interface 16. Depending on the embodiment, the operator interface 16 includes peripheral I/O devices such as keyboards, handheld operator devices, i.e. computer mouse, display monitors, disk drive memory devices, serial data ports, parallel data ports, printers, electronic card slots, RAM, ROM, hard drive, computer network connectivity, modems, wireless communication links, and/or voice activated control mechanisms.

The pilot advisory system also includes a word library 8 from which a combination of words are selected to create an advisory message. Each word is prerecorded using a human voice in the current embodiment and is converted to a binary file using a digital compression format. By selecting a string of these words from the word library 8, the monitoring CPU 10 generates an advisory message.

After the monitoring CPU 10 generates an advisory message based on the monitored data, the sequence of words selected from the word library 8 are fed into a voice synthesizer 22. The voice synthesizer 22 in turn replicates the sound of the prerecorded words to create an intelligible, audible message that is broadcasted to aircraft 28 over the CTAF channel 26 using a radio transmitter 24.

It should be understood, however, that other voice synthesizing methods can be employed to achieve the same result. For instance, according to the principles of the present invention, the monitoring computer 10 alternatively generates a voice message rather than selecting words from a library and sequentially playing the prerecorded words.

The monitoring CPU 10 is also interfaced to alternate communication links 20 that enable the advisory system to transmit messages to parties other than pilots. For instance, the monitoring CPU 10 may detect when an airplane comes to an abrupt halt most likely indicating that an aircraft has crashed and an emergency rescue operation is in order. It is a particularly grave situation if the "stop" is not near a runway. After detecting such an event, the monitoring CPU 10 immediately issues an advisory message to the appropriate authorities. Information with respect to the crash, such as the whereabouts of the aircraft, is included in advisory message. Alternative communication links 20 include telephone lines, Internet links, network links, emergency radio frequencies or other suitable communication channels. An example of an emergency advisory message includes: "Nine-one-one, this is an automated emergency call. An aircraft accident has been detected to the East of the Potomac Airfield."

The monitoring CPU 10 is also linked to a radio receiver 24 tuned to the CTAF channel 26, which is monitored for a number of reasons. First, the length of each advisory message is tailored with respect to the traffic on the CTAF channel 26. For example, advisory messages are controlled to be longer and, hence, more detailed when the channel is not in use by other pilots. On the other hand, advisory messages may be shortened to include only critical information when the channel is heavily used by pilots. Effectively, this optimizes CTAF channel communications.

Additionally, the CTAF channel 26 is monitored for new target aircraft. When a new aircraft is detected in the monitored airspace, a greeting message is generated by the monitoring CPU 10 and broadcasted to pilots over the CTAF channel 26 via the radio transmitter 24. The greeting message includes information alerting pilots that an "automated air traffic advisory system" is monitoring the airspace and generating advisories. In other words, the pilot advisory system generates a message that informs new pilots of the system's presence and capabilities.

In one embodiment of the present invention, the monitoring CPU 10 monitors the CTAF channel for pilot advisory requests. For example, a request may take the form of rapidly clicking the pilots radio microphone. Three clicks may indicate a pilot request for aircraft location information. After detecting a request, the monitoring CPU 10 generates the appropriate advisory and broadcasts it over the CTAF channel 26. One example of a pilot actuated advisory response describes present air traffic conditions: "Potomac Airfield automated advisory, wind two-two-zero at nine, altimeter three-zero point one-two, traffic using runway two-four, one target on downwind." If many air targets exist in the area, the advisory message will describe the present air traffic conditions as: "Potomac Airfield automated advisory, wind two-two-zero at nine, traffic using runway two-four, multiple targets in pattern."

Figure 3:
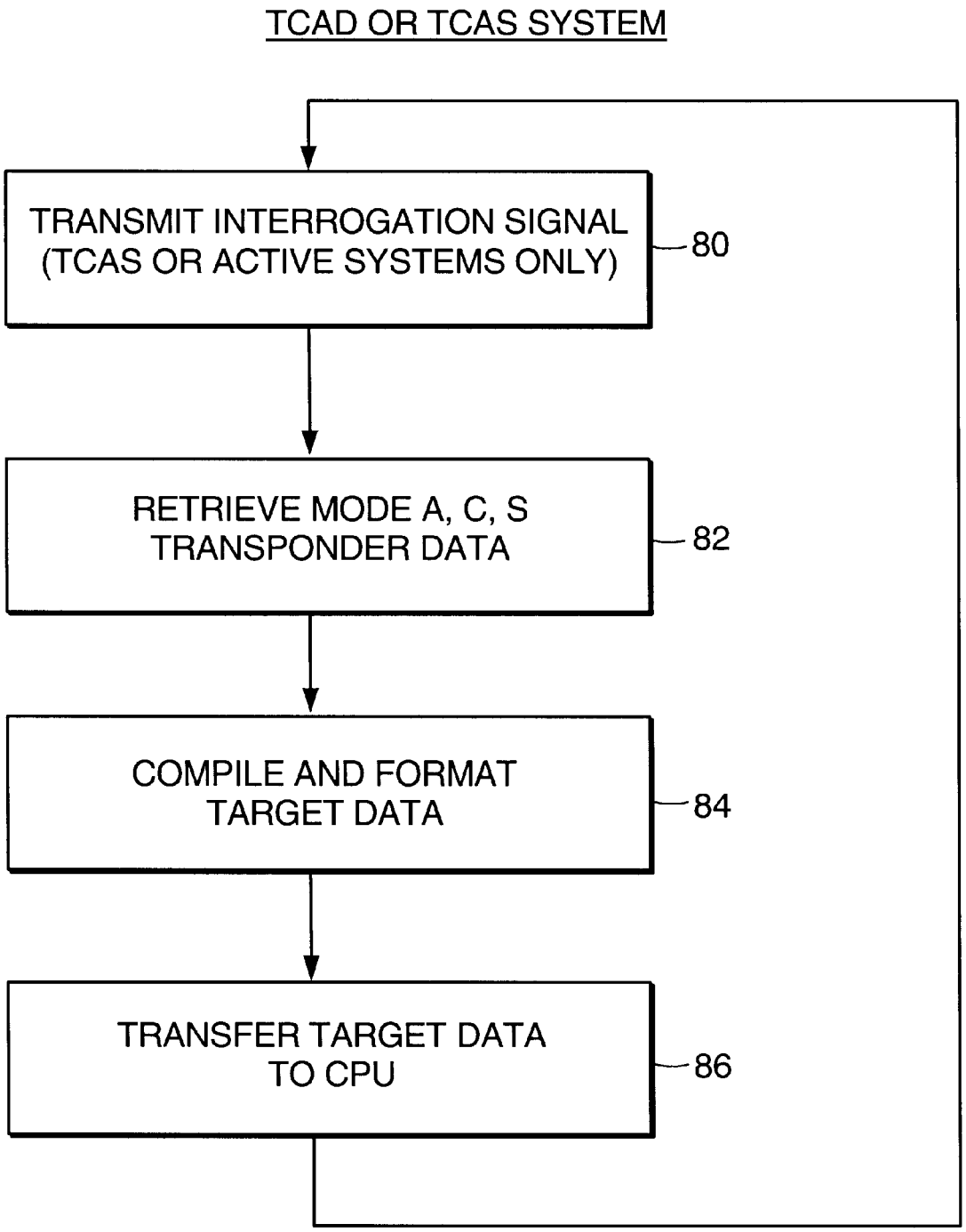
FIG. 3 is a flow diagram describing the inventive TCAS and TCAD system monitoring routine.

FIG. 3 describes the general operation of a TCAD or TCAS system. Note that steps 82, 84 and 86 pertain to both TCAD and TCAS systems while step 80 pertains only to TCAS systems which are capable of generating interrogation signals.

If a TCAS device is used in the pilot advisory system, the TCAS issues interrogation signals eliciting responses from nearby aircraft transponders in step 80. TCAD systems, as mentioned, rely on interrogation signals issued by nearby devices.

In step 82, the TCAD and TCAS systems monitor and retrieve mode A, C and S transponder data from the devices in the monitored airspace. As mentioned, the surveillance devices in essence "listen" to and record the transponder response information.

After the transponder data is retrieved in step 82, the information is compiled and formatted in step 84 by the TCAD or TCAS system. Thereafter in step 86, the formatted data is transferred to the monitoring CPU 10 which is used to update the airspace model 18. Frequent polling of transponders in the airspace by the TCAD or TCAS system assures that the airspace model 18 is kept up to date. As a result, the monitoring CPU generates advisory messages based on fresh data.

Figure 4:
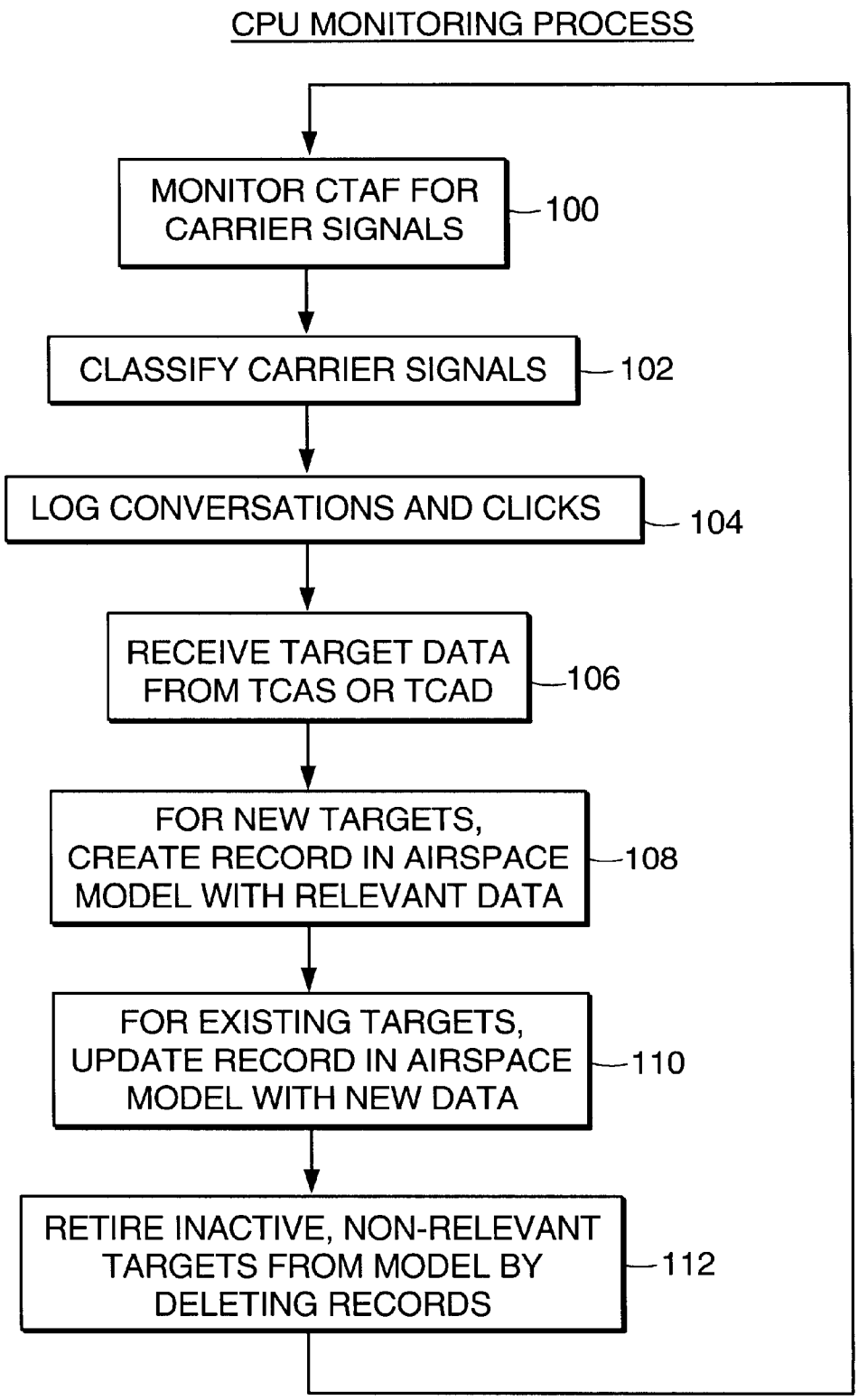
FIG. 4 is a flow diagram of the inventive CPU advisory process.

The flowchart in FIG. 4 outlines the CPU monitoring process. In order to generate accurate and relevant advisories, the CPU creates a mathematical airspace model 18 comprising records of relevant air traffic control data such as aircraft location information, weather conditions, CTAF channel traffic and airport procedures.

In step 100, the CPU monitors the CTAF channel for carrier signals. The central processing unit determines the length of each carrier detect signal and classifies each occurrence of the signal in step 102 as either a transient, a click or a conversation. If the length of the carrier detect signal is less than 55 milliseconds then the central processing unit assumes that a transient such as an atmospheric discharge has occurred. If the carrier detect signal is between 55 milliseconds and 715 milliseconds, the CPU classifies this event as a click which is the depression and release of a transmit button by a pilot. A consecutive series of clicks represent a coded request for information. For example, three clicks represents a request for an aircraft location advisory in one embodiment. Finally, if the length of the carrier detect signal exceeds 750 milliseconds, the signal is classified as a conversation. The monitored conversations and clicks are logged in step 104 including the date, time, classification, and duration of the particular event.

The logged information, in turn, is used to optimize the length of the advisory message. When the CTAF channel is burdened by heavy volume, the length of an advisory message is appropriately shortened to include the most important information. Conversely, if the CTAF channel is rarely used by pilots, longer and more detailed advisory messages are generated by the monitoring CPU.

The monitoring CPU constantly receives aircraft information updates from the TCAD or TCAS system in step 106. And based on the retrieved information, a record is created in step 108 for each new aircraft target in the monitored airspace. The record includes aircraft location information, aircraft registration, aircraft type, and any other relevant air traffic control information with respect to the target aircraft. For existing targets, known to be within the monitored airspace, the record is updated in step 110 to aid in determining their probable trajectory. If an aircraft discontinues responding to interrogation signals, it is presumed that the target aircraft has flown out of the monitored airspace. In this case, the tracking information record is deleted in step 112 so that the memory resources are available for new aircraft.

Figure 5:
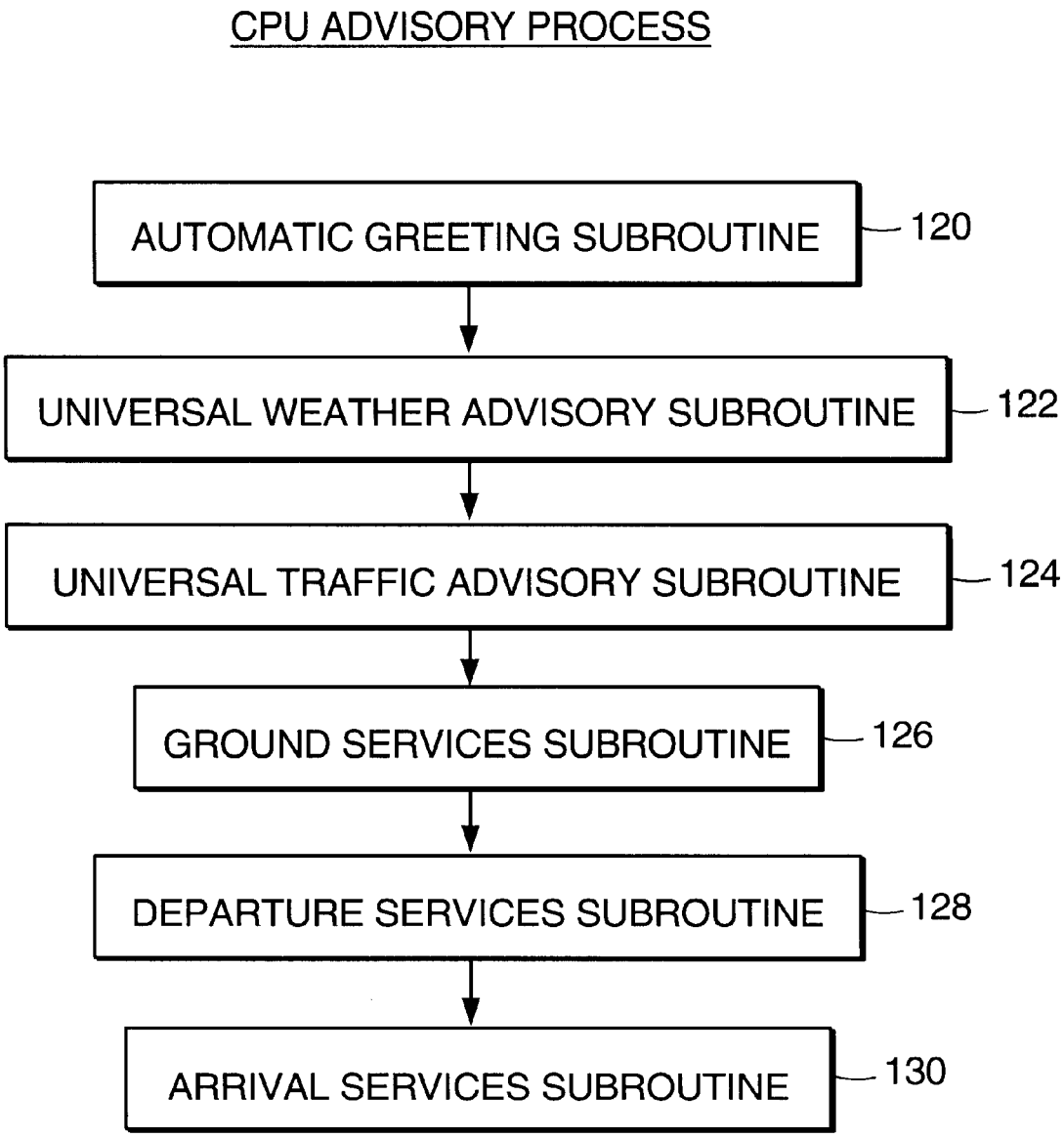
FIG. 5 shows the various inventive subroutines used in the advisory process.

FIG. 5 lists the various subroutines included in the CPU advisory process. The subroutines include: Automatic Greeting 120, Universal Weather Advisory 122, Universal Traffic Advisory 124, Ground Services 126, Departure Services 128 and Arrival Services 130. Refer to FIGS. 6–11 for a detailed flowchart of each subroutine.

Figure 6:
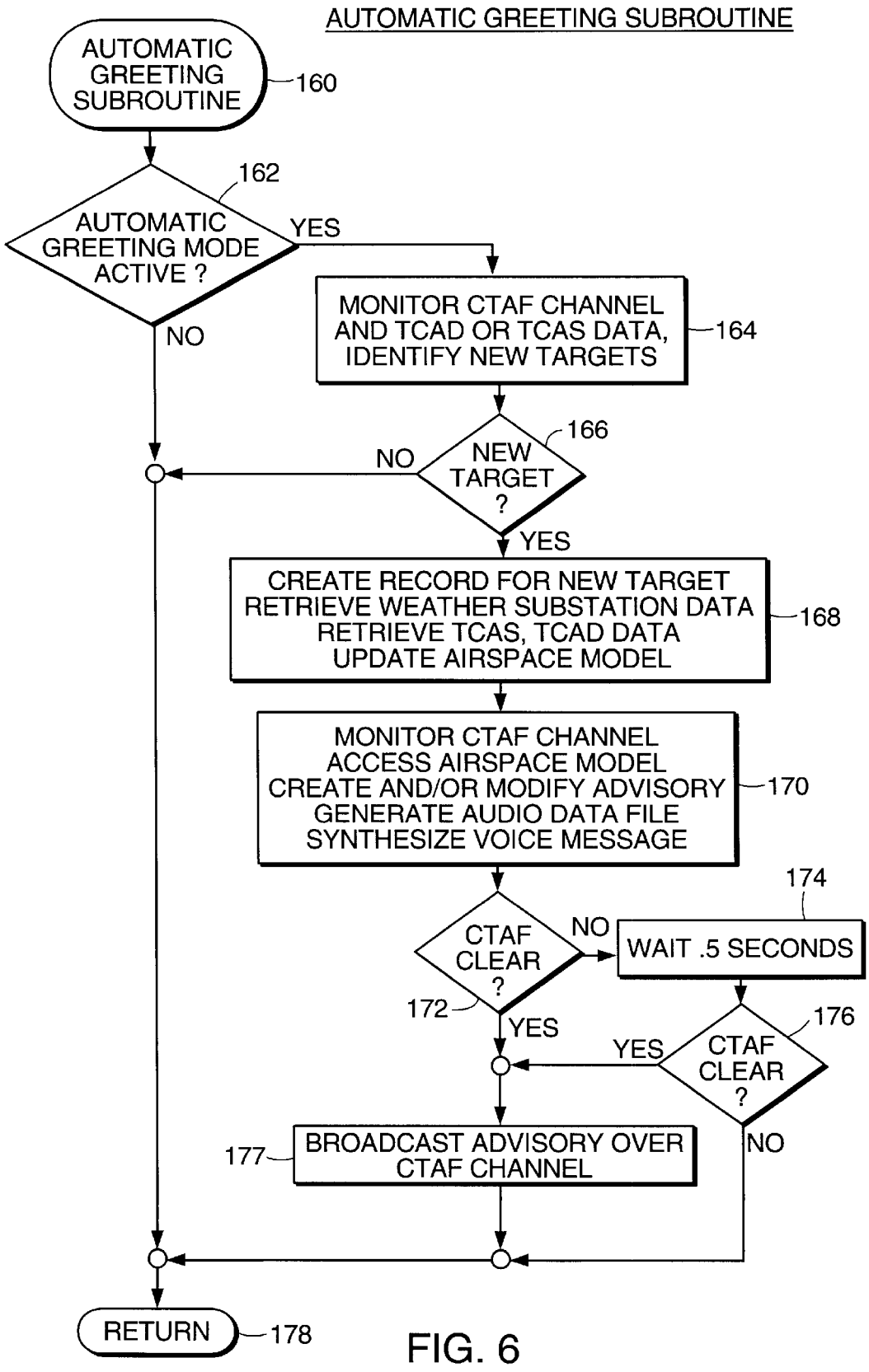
FIG. 6 is a flowchart of the inventive Automatic Greeting Subroutine.

The Automatic Greeting Subroutine shown in flowchart FIG. 6 performs the task of identifying new aircraft targets and greeting new pilots in the monitored airspace. Step 160 shows the starting point of the subroutine. If the automatic greeting mode is active in step 162, the CPU monitors the CTAF channel activity and aircraft location information generated by the TCAD and TCAS surveillance device to identify new targets in step 164.

If a new target is not detected in step 166, the processor returns from the subroutine using the exit point in step 178. If a new aircraft is detected in the monitored airspace in step 166, the monitoring CPU creates a new record in the airspace model in step 168.

The purpose of the next sequence of steps in FIG. 6 is to alert the pilot that the airspace is being monitored by the pilot advisory system which acts, in some respects, as an automated air traffic advisory system. Before generating an advisory, relevant weather and aircraft location information in the airspace model is updated in step 168. This includes monitored information from the weather monitor substation and TCAD or TCAS system. Once updated, the airspace model is reviewed in step 170 and the monitoring CPU creates an advisory message based on the air traffic data. For example, a greeting advisory message is generated informing new pilots in the airspace about the presence and capabilities of the pilot advisory system such as "Good afternoon, aircraft inbound from the south, traffic at Potomac is using runway two-four, two on downwind, one on base, wind two-two-zero at nine knots, altimeter three-zero point one-two." Specifically, a sequential list of prerecorded words is selected from the word library 8 to create an advisory message in step 170.

After the CPU generates the appropriate digital audio data file for the voice message, the CTAF channel is monitored to determine whether it is clear of traffic in step 172. The advisory system should generally not interfere with communications between pilots. If the CTAF channel is clear, the advisory message is then broadcasted over the CTAF channel in step 177 and the CPU exits from the subroutine. Alternatively, if the CTAF channel is busy in step 172, the monitoring CPU will wait .5 seconds in step 174 and then check again in step 176 to determine if the CTAF channel is clear. If CTAF channel is clear in step 176, the advisory message is broadcasted over the CTAF channel in step 177. If the CTAF channel is still not clear in step 176, the CPU returns from the subroutine to the main program using the exit point in step 178. Generally, all of the subroutines follow a similar methodology of creating and broadcasting messages over the CTAF channel.

Figure 7:
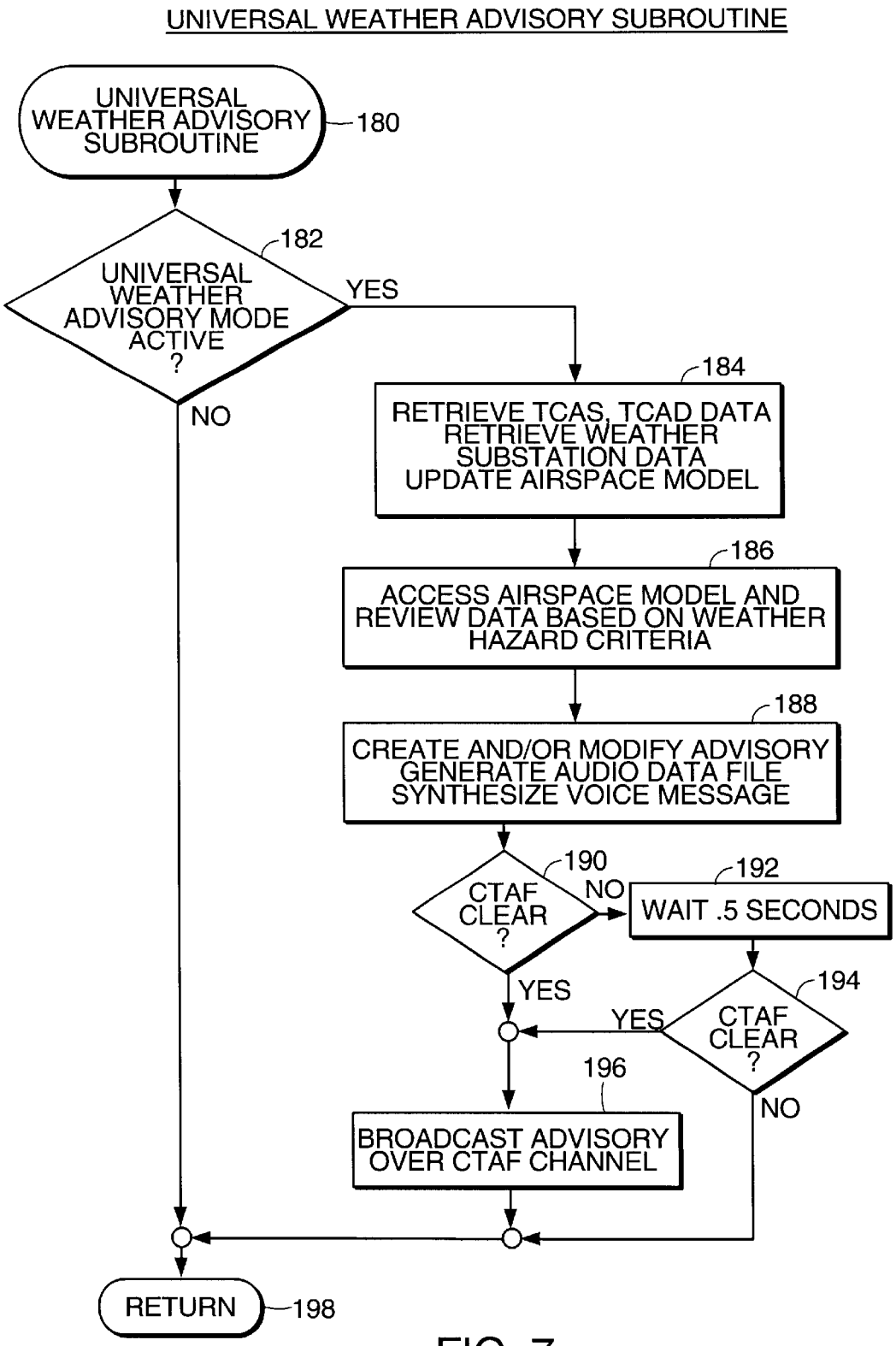
FIG. 7 is a flowchart of the inventive Universal Weather Advisory Subroutine.

The Universal Weather Advisory subroutine shown in flowchart FIG. 7 generally performs the task of reviewing the weather data and generating appropriate advisories which are later broadcasted over the CTAF channel. Step 180 shows the starting point of the subroutine. If the universal weather advisory mode is active in step 182, the monitoring CPU updates the information in the airspace model in step 184. Thereafter, the monitoring CPU reviews the airspace model data in step 186 and, based on hazard criteria/guidelines, the CPU creates and/or modifies an advisory message in step 188. For example, according to one aspect of the invention, an advisory message is generated informing pilots in the airspace about the presence and danger of sudden wind changes such as "Aircraft on final to runway two-four, wind now three-three-zero at one-five peak two-zero, caution, crosswind." Specifically, a sequential list of prerecorded words is selected from the word library 8 to create an advisory message in step 188. Depending on the current weather conditions, more urgent messages are automatically generated for more hazardous situations.

After the CPU generates the appropriate digital audio data file for the voice message, the CTAF channel is monitored to determine whether it is clear of traffic in step 190. The advisory system should generally not interfere with communications between pilots. If the CTAF channel is clear, the advisory message is then broadcasted over the CTAF channel in step 196 and the CPU exits from the subroutine. Alternatively, if the CTAF channel is busy in step 190, the monitoring CPU will wait .5 seconds in step 192 and then check again in step 194 to determine if the CTAF channel is clear. If CTAF channel is clear in step 194, the advisory message is broadcasted over the CTAF channel in step 196. If the CTAF channel is still not clear in step 194, the CPU returns from the subroutine to the main program using the exit point in step 198.

Figure 8:
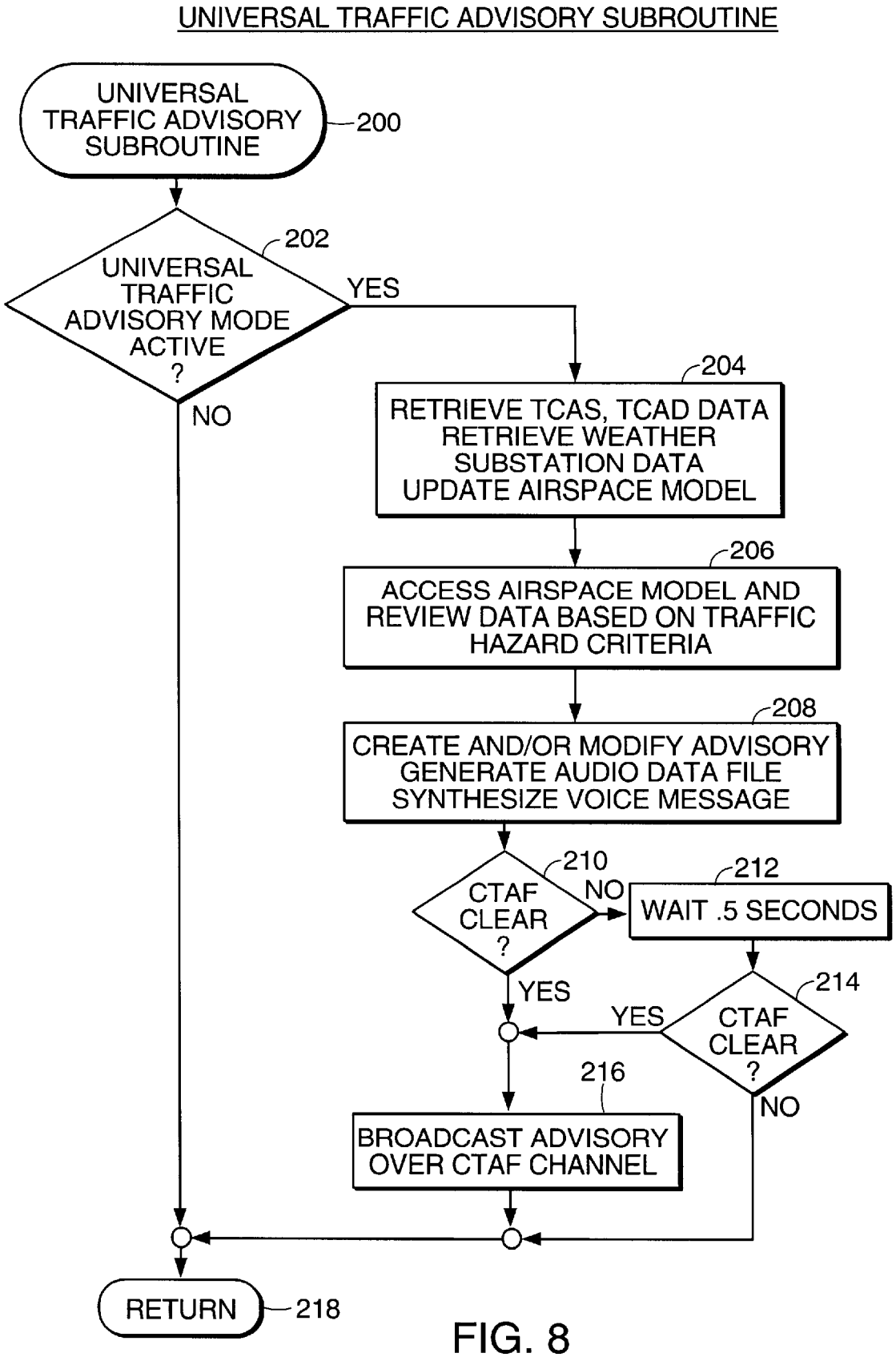
FIG. 8 is a flowchart of the inventive Universal Traffic Advisory Subroutine.

The Universal Traffic Advisory subroutine shown in flowchart FIG. 8 generally deals with the task of reviewing aircraft conflict information and generating appropriate advisories that are broadcasted over the CTAF channel. Step 200 shows the starting point of the subroutine. If the universal traffic advisory mode is active in step 202, the monitoring CPU updates the information in the airspace model in step 204. Thereafter, the monitoring CPU reviews the aircraft trajectories in step 206, and based on conflict criteria guidelines, creates an appropriate advisory message in step 208. For example, if the projected trajectory of two aircraft indicates that a mid-air conflict is imminent, an urgent advisory message targeted to appropriate pilots is generated in the form of an audio data file in step 208. For example, according to one aspect of the invention, an advisory message is generated informing pilots in the airspace about the presence of other aircraft dangerously close in proximity such as "Traffic alert, downwind targets merging at one-three-zero-zero feet." Specifically, a sequential list of prerecorded words is selected from the word library 8 to create an advisory message in step 208.

Further examples based on observed data include: "Traffic at Potomac, be advised IFR traffic is inbound on the approach to runway zero-six." "Traffic alert!, conflicting traffic using cross runway." "Traffic alert!, targets merging in the downwind for runway two-four." "Traffic alert!, conflicting traffic on final runaway two-four." "Traffic alert! conflicting traffic departing on runway zero-six"

After the CPU generates the appropriate digital audio data file for the voice message in step 208, the CTAF channel is monitored to determine whether it is clear of traffic in step 210. The advisory system should generally not interfere with communications between pilots. If the CTAF channel is clear, the advisory message is then broadcasted over the CTAF channel in step 216 and the CPU exits from the subroutine in step 218. Alternatively, if the CTAF channel is busy in step 210, the monitoring CPU will wait 0.5 seconds in step 212 and then check again in step 214 to determine if the CTAF channel is clear. If CTAF channel is clear in step 214, the advisory message is broadcasted over the CTAF channel in step 216. If the CTAF channel is still not clear in step 214, the CPU returns from the subroutine to the main program using the exit point in step 218.

Figure 9:
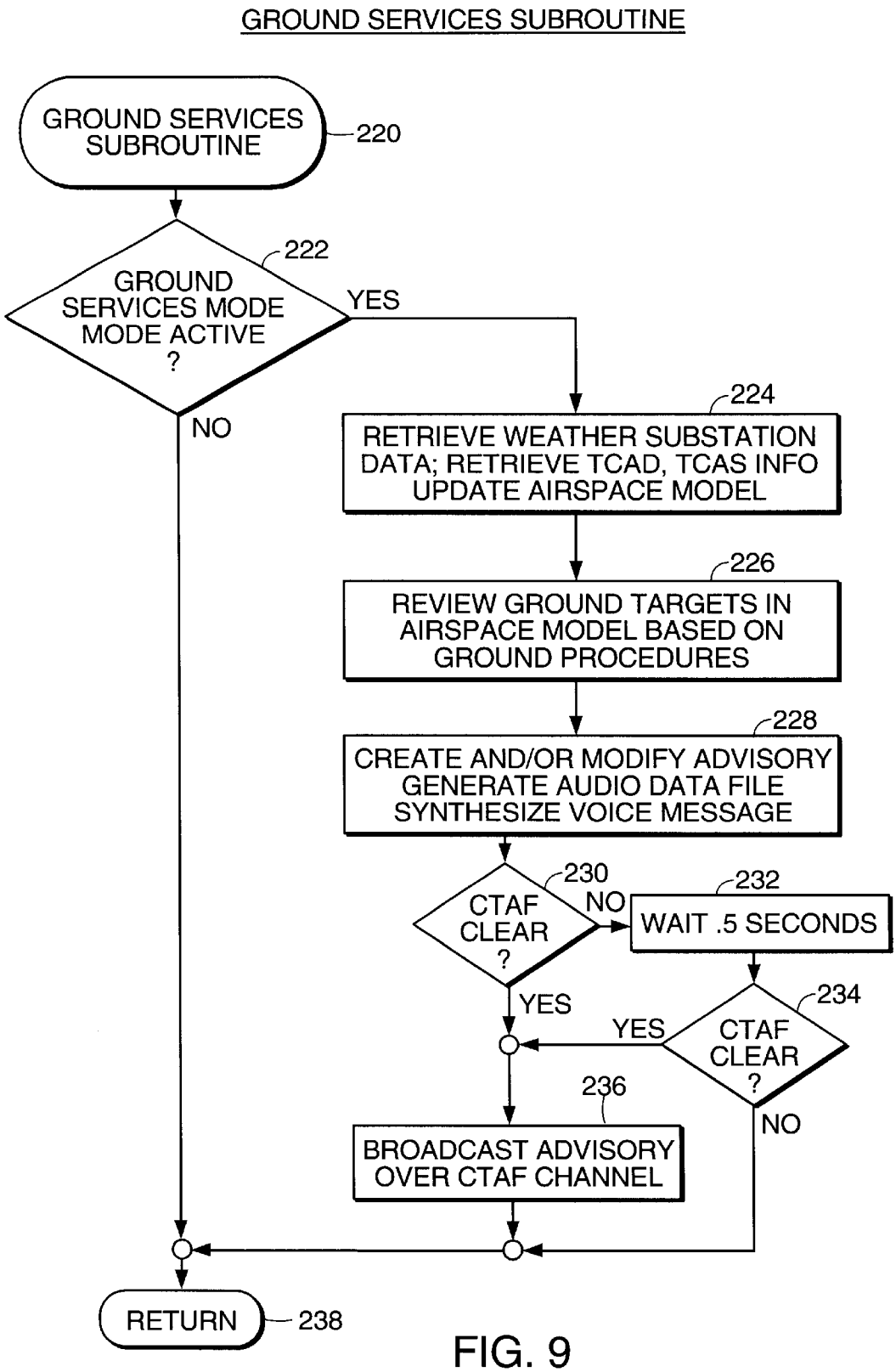
FIG. 9 is a flowchart of the inventive Ground Services Subroutine.
Figure 10:
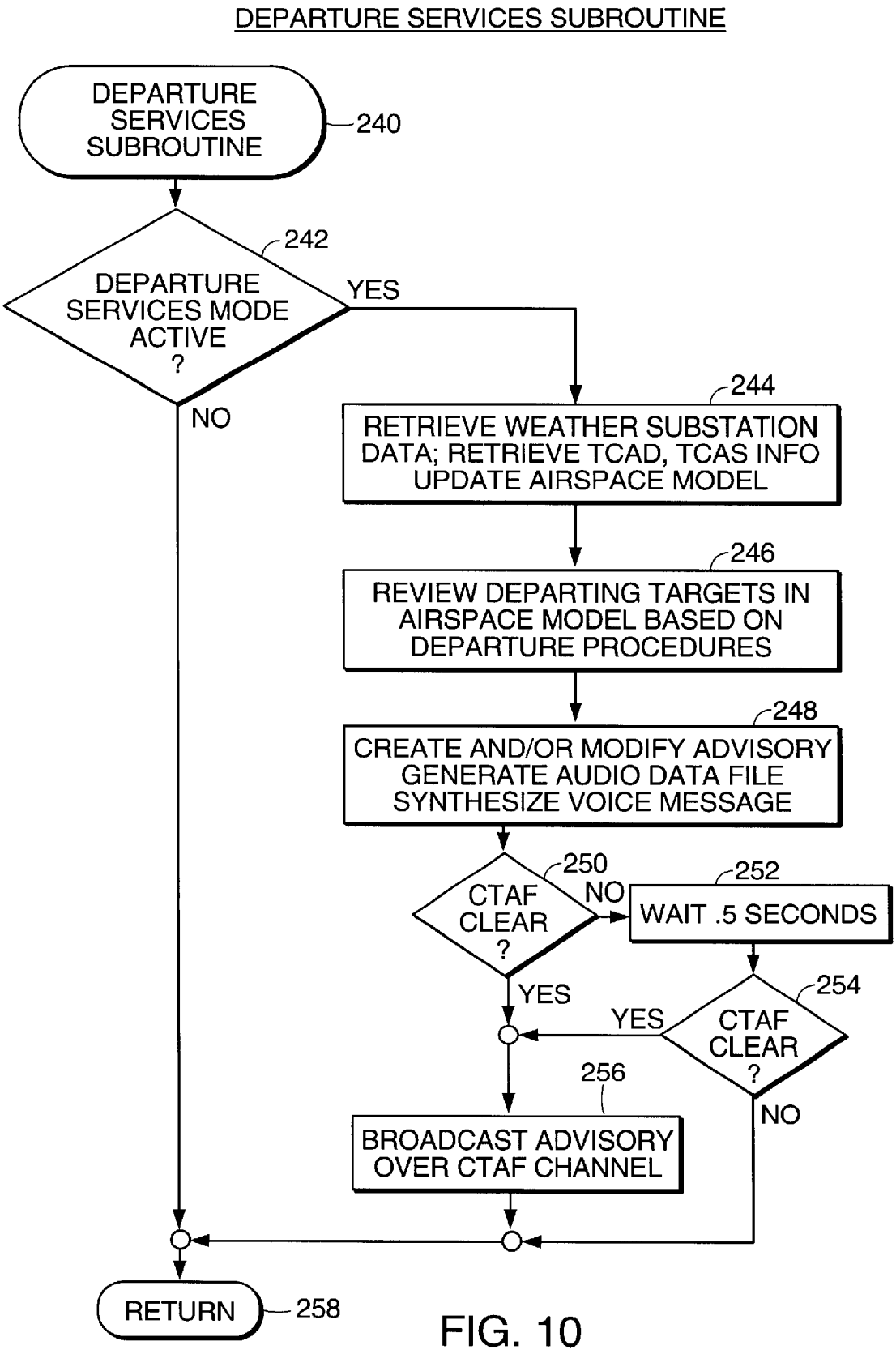
FIG. 10 is a flowchart of the inventive Departure Services Subroutine.
Figure 11:
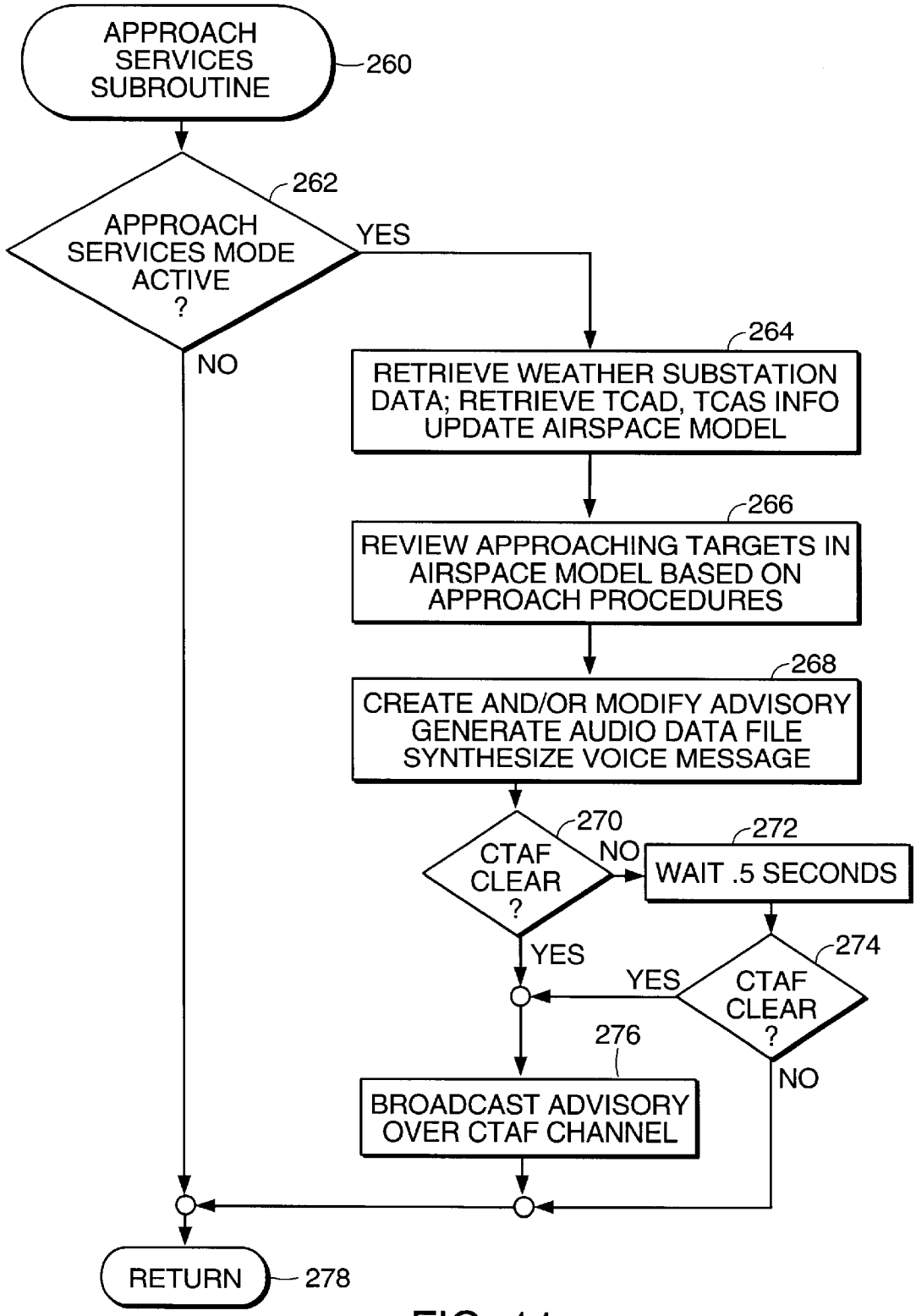
FIG. 11 is a flowchart of the inventive Arrival Services Subroutine.

The subroutines shown in FIGS. 9, 10, and 11 deal with air traffic in close proximity to the airport. Generally, the subroutines deal with departure, arrival and ground services near an airport. In each subroutine, advisories are generally based upon three sources of information: weather, air traffic and airport procedures.

Weather data includes parameters such as windspeed and direction indicating crosswinds, dangerous to both arriving and departing aircraft. Other important weather information includes conditions such as ice, fog and lightning storms. All of these conditions can pose a serious threat to both the pilot and passengers.

Air traffic information includes parameters such as aircraft location, type of aircraft, and altitude. Based upon the aircraft trajectory data, the monitoring CPU determines the projected path of the aircraft. This enables the CPU to generate advisories alerting pilots of impending danger with respect to other aircraft. It is particularly important to monitor aircraft near the airport because air traffic conflicts are much more likely to occur in these high density areas.

Airport procedures include guidelines that pilots must follow to land or depart from an airport. For example, landing procedures may require specific flight patterns or a particular runway may be closed during early morning hours due to predictable heavy winds. By coordinating and controlling these and other flight aspects, overall safety is enhanced for both airborne and ground based parties.

The Ground Services Subroutine as shown in flowchart FIG. 9 concerns the task of providing pilots with information related to ground services and procedures. The entry point of the subroutine is step 220. If the ground services mode is active in step 222, the monitoring CPU initially retrieves weather and aircraft information to update the airspace model in step 224. Thereafter, the ground targets are reviewed in step 226 and, based on ground procedures for a given airport, the monitoring CPU creates an appropriate advisory message in step 228 for the ground based targets. Similar to the other subroutines, the CPU generates a digital audio data file in step 228. For example, according to one aspect of the invention, an advisory message is generated informing pilots in the airspace about ground services and procedures such as "Taxiing aircraft, be advised an aircraft is on short-final for runway two-four," or "Runway two-four is now clear." Specifically, a sequential list of prerecorded words is selected from the word library 8 to create an advisory message in step 228. Other advisories include information such as: "Aircraft just arrived at Potomac, visitor parking is in the second row, please remember to cancel your flight plan with National on one-two-six point five-five." or "Aircraft just arrived at Potomac, visitor parking is in the second row, welcome. Taxi and hotel services are available inside."

After the CPU generates the appropriate digital audio data file for the voice message in step 228, the CTAF channel is monitored to determine whether it is clear of traffic in step 230. The advisory system should generally not interfere with communications between pilots. If the CTAF channel is clear, the advisory message is then broadcasted over the CTAF channel in step 236 and the CPU exits from the subroutine in step 238. Alternatively, if the CTAF channel is busy in step 230, the monitoring CPU will wait 0.5 seconds in step 232 and then check again in step 234 to determine if the CTAF channel is clear. If CTAF channel is clear in step 234, the advisory message is broadcasted over the CTAF channel in step 236. If the CTAF channel is still not clear in step 234, the CPU returns from the subroutine to the main program using the exit point in step 238. In this way, a pilot may be apprised of appropriate ground procedures even though he is unfamiliar with the airport. The advisories also serve to inform pilots of the positions and intentions of other air traffic.

The Departure Services Subroutine flowchart in FIG. 10 focuses on informing pilots about related departure procedures. Step 240 shows the starting point of the subroutine. If the departure services mode is active in step 242, the monitoring CPU retrieves the appropriate information to update the airspace model in step 244. Departing aircraft in the airspace model are reviewed in step 246 and, based on airport departure procedures, the monitoring CPU generates an appropriate advisory message in the form of an audio data file in step 248. For example, according to one aspect of the invention, an advisory message is generated informing pilots in the airspace about departure services and procedures such as "Aircraft departing Potomac, Washington departure control is available on one-two-six point five-five, have a nice trip." Specifically, a sequential list of prerecorded words is selected from the word library 8 to create an advisory message in step 248.

After the CPU generates the appropriate digital audio data file for the voice message in step 248, the CTAF channel is monitored to determine whether it is clear of traffic in step 250. The advisory system should generally not interfere with communications between pilots. If the CTAF channel is clear, the advisory message is then broadcasted over the CTAF channel in step 256 and the CPU exits from the subroutine in step 258. Alternatively, if the CTAF channel is busy in step 250, the monitoring CPU will wait 0.5 seconds in step 252 and then check again in step 254 to determine if the CTAF channel is clear. If CTAF channel is clear in step 254, the advisory message is broadcasted over the CTAF channel in step 256. If the CTAF channel is still not clear in step 254, the CPU returns from the subroutine to the main program using the exit point in step 258.

FIG. 11 shows a flow diagram of the Approach Services Subroutine. When the approach services mode is active per the query in step 262, the monitoring CPU updates the airspace model 264 using retrieved weather and air traffic information from the weather monitor substation and TCAD/TCAS system respectively. The monitoring CPU tracks approaching aircraft and reviews their trajectories in step 266 based on the airport's programmed approach procedures, as well as other information in the airspace model. While monitoring the volume of communication on the CTAF channel, an advisory message of the appropriate length and content is generated in step 268 by the monitoring CPU. For example, a pilot may avert the danger associated with landing on a runway plagued by heavy crosswinds once alerted to this fact by an advisory issued over the CTAF channel. Additionally, an approaching pilot would be advised of an opposing aircraft ready to take off on the same runway. For example, according to one aspect of the invention, an advisory message is generated informing pilots in the airspace about arrival services and procedures such as "Aircraft on final runway two-four, wind now three-two-zero at one-nine, caution, crosswind." Specifically, a sequential list of prerecorded words is selected from the word library 8 to create an advisory message in step 268.

After the CPU generates the appropriate digital audio data file for the voice message in step 268, the CTAF channel is monitored to determine whether it is clear of traffic in step 270. The advisory system should generally not interfere with communications between pilots. If the CTAF channel is clear, the advisory message is then broadcasted over the CTAF channel in step 276 and the CPU exits from the subroutine in step 278. Alternatively, if the CTAF channel is busy in step 270, the monitoring CPU will wait 0.5 seconds in step 272 and then check again in step 274 to determine if the CTAF channel is clear. If CTAF channel is clear in step 274, the advisory message is broadcasted over the CTAF channel in step 276. If the CTAF channel is still not clear in step 274, the CPU returns from the subroutine to the main program using the exit point in step 278. The content of the advisory message includes relevant air traffic control information enabling the pilot to make a safe approach into the airport.

The present invention seeks to remedy the aforementioned dangers associated with air travel using an automated monitor system capable of generating and automatically broadcasting advisories to targeted pilots. In short, the system may be viewed in some respects as an electronic, rather than human, air traffic controller.

In particular, the present invention seeks to expand the role of the Common Traffic Advisory Frequency (CTAF), or any other general communication channel, by providing automatic advisories in response to situations that warrant a broadcast of information over the CTAF channel, making pilots cognizant of relevant flight conditions or other pertinent air traffic information.

Not all of the advisories generated by the pilot advisory system are based on life threatening circumstances. Some announcements over the shared communication frequency are made simply to assure that controversial situations are not created in the first place. For example, an announcement about runway landing hours informs pilots about a given airport's landing or take-off procedures: "Aircraft about to depart at Potomac, departures discouraged after eleven PM, thank you."

Since a pilot commonly eavesdrops on the CTAF communication channel, there is little or no extra effort expended by the pilot to gain access to the advisory. His attention, therefore, may be focused on more important matters such as steering the airplane and monitoring critical instrument panel gauges.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A system for broadcasting advisories, the system comprising:

an aircraft monitoring subsystem that generates aircraft location information;

a central processing unit that (i) tracks aircraft using the location information and (ii) automatically generates advisories for multiple remotely located transceivers using the aircraft location information; and a transmitter coupled to the central processing unit that broadcasts the advisories to the transceivers over a voice-based, shared radio frequency also used for two-way radio communications among the transceivers.

2. A system as described in claim 1, further comprising:

a weather monitoring subsystem that monitors local weather conditions and generates local weather information, wherein the central processing unit generates advisories based on the weather information.

3. A system as described in claim 1, further comprising:

a data storage device, coupled to and accessible by the central processing unit, that stores the location information of aircraft near the airport.

4. A system as described in claim 1, wherein the central processing unit generates advisories based on aircraft flight trajectories.

5. A system as described in claim 1, wherein the central processing unit generates advisories which are broadcasted by the transmitter and targeted to specific pilots based on aircraft location information.

6. A system as described in claim 1, further comprising:

a voice synthesizer, coupled to the central processing unit, that translates an advisory into an audible communication which is broadcasted to pilots by the transmitter.

7. A system as described in claim 1, further comprising:

a communication link for transmitting messages to ground-based parties.

8. A system as described in claim 1, wherein the aircraft monitoring subsystem is capable of interrogating aircraft surveillance equipment and converting received signals to aircraft locations.

9. A system as described in claim 1, wherein the aircraft monitoring subsystem includes a mode S receiver capable of converting retrieved data into the aircraft location information.

10. A system as described in claim 1, wherein the aircraft monitoring subsystem includes a mode C receiver capable of converting retrieved data into the aircraft location information.

11. A system as described in claim 1, wherein the aircraft monitoring subsystem includes a mode A receiver capable of converting retrieved data into the aircraft location information.

12. A system as described in claim 1, wherein the central processing unit selects words from a library and strings them together to generate an advisory message.

13. A system as described in claim 1, further comprising:

a radio frequency receiver, coupled to the central processing unit, that detects a pilot request for an advisory, wherein the central processing unit generates advisories in response to the pilot request.

14. A system as described in claim 1, further comprising:

an operator interface, coupled to the central processing unit, that enables an operator to create advisories, broadcasted by the transmitter, based on airport incidents, conditions and/or procedures.

15. A system as described in claim 1, further comprising:

a radio frequency receiver, coupled to the central processing unit, that detects transmissions on the shared radio frequency, wherein a length of the advisory is changed depending on the detected transmissions.

16. A system as described in claim 1, wherein the central processing unit generates an advisory message directed to new pilots entering a monitored airspace about air traffic conditions and/or originating source of the advisory messages.

17. A system as described in claim 2, wherein the central processing unit generates a weather advisory message based on monitored weather conditions.

18. A system as described in claim 1, wherein the central processing unit generates a traffic advisory message based on monitored air traffic information.

19. A system as described in claim 1, wherein the central processing unit generates an advisory message about ground services and/or procedures.

20. A system as described in claim 1, wherein the central processing unit generates an advisory message about departure services and/or procedures.

21. A system as described in claim 1, wherein the central processing unit generates an advisory message about arrival services and/or procedures.

22. A system as described in claim 1, wherein the central processing unit monitors the aircraft location information to learn common flight patterns.

23. A method for broadcasting advisories comprising the steps of:

detecting positions of aircraft and generating aircraft location information;

at a central location, tracking aircraft using the aircraft location information and automatically generating advisories for multiple remotely located transceivers in response to the aircraft location information; and transmitting the advisories to the transceivers over a voice-based, shared radio frequency communication link also used for two-way radio communications among the transceivers.

24. A method as described in claim 23, further comprising the steps of:

detecting ambient weather conditions using a weather monitoring subsystem that generates weather information; and generating advisories in response to the weather information.

25. A method as described in claim 23, further comprising the step of:

storing the aircraft location information in a data storage device.

26. A method as described in claim 23, further comprising the step of:

generating advisories based on aircraft flight trajectories.

27. A method as described in claim 23, further comprising the step of:

generating advisories and transmitting the advisories to specific pilots based on aircraft location information.

28. A method as described in claim 23, further comprising the steps of:

converting generated advisories into audible communications using a voice synthesizer; and transmitting the audible communications to aircraft over a shared radio frequency.

29. A method as described in claim 23, further comprising the step of:

transmitting messages to ground based parties.

30. A method as described in claim 23, wherein the step of detecting positions of aircraft and generating aircraft location information comprises:

detecting positions of aircraft and generating aircraft location information using a mode S receiver.

31. A method as described in claim 23, wherein the step of detecting positions of aircraft and generating aircraft location information comprises:

detecting positions of aircraft and generating aircraft location information using a mode C receiver.

32. A method as described in claim 23, wherein the step of detecting positions of aircraft and generating aircraft location information comprises:

detecting positions of aircraft and generating aircraft location information using a mode A receiver.

33. A method as described in claim 23, wherein the step of generating advisories includes:

selecting words from a library to create an intelligible message.

34. A method as described in claim 23, wherein the step of determining aircraft location information comprises:

interrogating an aircraft and converting received signals to corresponding aircraft location information.

35. A method as described in claim 23, further comprising the step of:

detecting a pilot advisory request on a radio channel; and generating an advisory based on the pilot advisory request.

36. A method as described in claim 23, further comprising the step of:

enabling an operator to create advisories based on airport incidents, conditions and/or procedures.

37. A method as described in claim 23, further comprising the step of:

determining a level of traffic on the shared radio frequency; and adaptively changing a length of the advisory in response to the traffic.

38. A method as described in claim 23 further comprising the step of:

learning common flight patterns based on monitored aircraft location information.

39. A method as described in claim 23 further comprising the step of:

detecting new pilots entering a monitored airspace; and generating and broadcasting an advisory message to the new pilots about air traffic conditions and/or originating source of the advisory messages.

40. A method as described in claim 24 further comprising the step of:

generating and broadcasting a weather advisory message based on monitored weather conditions.

41. A method as described in claim 23 further comprising the step of:

generating and broadcasting a traffic advisory message based on monitored air traffic information.

42. A method as described in claim 23 further comprising the step of:

generating and broadcasting a traffic advisory message based on ground services and/or procedures.

43. A method as described in claim 23 further comprising the step of:

generating and broadcasting a traffic advisory message based on departure services and/or procedures.

44. A method as described in claim 23 further comprising the step of:

generating and broadcasting a traffic advisory message based on arrival services and/or procedures.

45. A system for broadcasting advisories at airports, comprising:

an aircraft monitoring subsystem that interrogates aircraft and generates location information of aircraft based on received signals;

a weather monitoring subsystem that monitors weather conditions at an airport;

a central processing unit coupled to the aircraft monitoring subsystem and weather monitoring subsystem that automatically generates advisories for multiple remotely located transceivers, the advisories being broadcast to pilots in response to the aircraft flight trajectories and weather conditions; and a transmitter coupled to the central processing unit that broadcasts the advisories to the transceivers over a voice-based, shared radio channel also used for two-way radio communications.

46. A system for broadcasting advisory messages, the system comprising:

a monitoring subsystem that generates location information of moving objects;

a central processing unit that (i) tracks trajectories of the moving objects using the location information and (ii) generates advisories for multiple remotely located receivers based on the location information; and a transmitter coupled to the central processing unit that broadcasts the advisories to the receivers over a voice-based, shared radio frequency channel also used for two-way radio communications.

47. A system as in claim 46, wherein at least one of the moving objects is a ground-based object.

48. A system as in claim 46, wherein at least one of the moving objects is a taxiing aircraft.

49. A system as in claim 46, wherein the advisories are transmitted over the shared radio frequency channel to prevent ground-based collisions.

50. A system as in claim 46, further comprising:

a data storage device, coupled to and accessible by the central processing unit, that stores static attributes of a monitored region which are used at least in part to generate advisories.

51. A system as in claim 46, wherein the central processing unit generates advisories based on aircraft flight trajectories.

52. A system as in claim 46, further comprising:

an alternate communication link other than the shared traffic channel for transmitting messages to ground-based parties.

53. A system as in claim 46, further comprising:

an operator interface, coupled to the central processing unit, that enables an operator to create advisories which are broadcasted by the transmitter, wherein the advisories are based on airport incidents, conditions and/or procedures.

54. A system as in claim 46, wherein the central processing unit generates advisories about ground services and/or procedures.

55. A method for broadcasting advisories comprising the steps of:

monitoring moving objects and generating corresponding location information about their position;

at a central location, tracking the moving objects using the location information and generating advisories for multiple remotely located receivers based on the location information; and transmitting the advisories to the receivers over a voice-based, shared radio frequency channel also used for two-way radio communications.

56. A method as in claim 55, wherein at least one of the moving objects is a ground-based object.

57. A method as in claim 55, wherein at least one of the moving objects is a taxiing aircraft.

58. A method as in claim 55, wherein the advisories are transmitted over the shared radio frequency channel to prevent ground-based collisions.

59. A method as in claim 55, further comprising the steps of:

storing static attributes of a monitored region in a data storage device; and generating advisories based on the moving objects and static attributes of the monitored region.

60. A method as in claim 55, wherein advisories are based at least in part on aircraft flight trajectories.

61. A method as in claim 55, further comprising:

transmitting messages to ground-based parties on an alternate communication link other than the shared radio frequency channel.

62. A method as in claim 55, further comprising:

enabling an operator to create advisories, wherein the advisories are based on airport incidents, conditions and/or procedures.

63. A method as in claim 55, wherein the central processing unit generates an advisory message about ground services and/or procedures.

64. A system as in claim 1, wherein the advisories are voice-based advisories automatically generated based on an airspace model of an airport.

65. A system as in claim 23, wherein the advisories are voice-based advisories automatically generated based on an airspace model of an airport.

66. A system as in claim 46, wherein the advisories are voice-based advisories automatically generated based on an airspace model of an airport.

67. A system as in claim 55, wherein the advisories are voice-based advisories automatically generated based on an airspace model of an airport.

* * * * *